United States Patent [19]

Kliem

[11] 4,003,744

[45] Jan. 18, 1977

[54] PHOTOGRAPHIC PRODUCTS WITH PHOTOSENSITIVE LAYERS OF SAME SPECTRAL SENSITIVITY AND DIFFERENT SPEED

[75] Inventor: Peter O. Kliem, Weston, Mass.

[73] Assignee: Polaroid Corporation, Cambridge, Mass.

[22] Filed: Aug. 2, 1974

[21] Appl. No.: 494,197

Related U.S. Application Data

[63] Continuation-in-part of Ser. No. 312,827, Dec. 7, 1972, abandoned.

[52] U.S. Cl. ..... 96/29 D; 96/3; 96/68; 96/73; 96/74; 96/77

[51] Int. Cl.[2] ..... G03C 5/54; G03C 1/76; G03C 7/00; G03C 1/40

[58] Field of Search ..... 96/3, 29 D, 77, 68, 96/74, 73

[56] References Cited

UNITED STATES PATENTS

| | | | |
|---|---|---|---|
| 2,376,217 | 5/1945 | Wilder | 96/74 |
| 2,983,606 | 5/1961 | Rogers | 96/3 |
| 3,188,209 | 6/1965 | Land et al. | 96/3 |
| 3,415,645 | 12/1968 | Land | 96/3 |
| 3,505,068 | 4/1970 | Beckett et al. | 96/68 |
| 3,516,831 | 6/1970 | Wolf et al. | 96/74 |
| 3,620,745 | 11/1971 | Seymour | 96/68 |
| 3,620,746 | 11/1971 | Barr | 96/68 |
| 3,620,747 | 11/1971 | Marchant | 96/68 |
| 3,663,228 | 5/1972 | Wyckoff | 96/74 |
| 3,728,121 | 4/1973 | Zorn et al. | 96/68 |

*Primary Examiner*—David Klein
*Assistant Examiner*—Richard L. Schilling
*Attorney, Agent, or Firm*—Stanley H. Mervis

[57] ABSTRACT

The present invention relates to photography and, more particularly, to diffusion transfer process photographic film units which comprise a photosensitive element adapted to provide, by diffusion transfer photographic processing, selective dye image recordation of incident actinic radiation as a function of the point-to-point degree of photosensitive element exposure, which film unit includes a plurality of photosensitive units each exhibiting a predetermined gamma of substantially the same value and within a range of 1.1 to 1.7 and at least one of the units includes, in contiguous relationship, a first silver halide photosensitive layer comprising a particulate dispersion of photosensitive silver halide crystals, preferably silver iodobromide, iodochloride and/or iodochlorobromide crystals, possessing a first gamma and a second silver halide photosensitive layer possessing a second gamma having disposed therein dye developer which is diffusible during processing as a function of the point-to-point degree of silver halide layer exposure to incident actinic radiation. The value of the first said gamma differs from that of said second gamma by at least about 0.25, said gammas, taken together, are within the range of about 1.7 to 3.0 and each is greater than the predetermined gamma, said first silver halide layer exhibits sensitivity to incident radiation actinic to the layer in excess of the sensitivity exhibited to said radiation by said second silver halide layer; and the photographic speed differential between said first and said second layer is within the range of about 1 to 7 stops, and a layer adapted to receive dye diffusing thereto; and to specified diffusion transfer processes employing such film units.

23 Claims, 12 Drawing Figures

PHOTOGRAPHIC PRODUCTS WITH PHOTOSENSITIVE LAYERS OF SAME SPECTRAL SENSITIVITY AND DIFFERENT SPEED

RELATED APPLICATION

The present application is a continuation-in-part of copending application for patent, Ser. No. 312,827, filed Dec. 7, 1972 (now abandoned), and assigned in common herewith.

BACKGROUND OF THE INVENTION

1. Field of the Invention

The present invention is directed to providing new and improved diffusion transfer process photographic film units adapted to provide, as a function of the point-to-point degree of photoexposure, by diffusion transfer processing a dye transfer image.

2. Description of Prior Art

As disclosed in U.S. Pat. No. 3,672,890 a composite photosensitive structure, particularly adapted for reflection type photographic diffusion transfer color process employment, which comprises a plurality of essential layers including, in sequence, a dimensionally stable layer preferably opaque to incident radiation; one or more silver halide emulsion layers having associated therewith a diffusion transfer process dye image-providing material; a polymeric layer adapted to receive solubilized dye image-providing material diffusing thereto; and a dimensionally stable transparent layer, may be exposed to incident actinic radiation anad processed by interposing, intermediate the silver halide emulsion layer and the reception layer, a processing composition and an opacifying agent, which may reflect incident radiation, in a quantity sufficient to mask dye image-providing material associated with the silver halide emulsion.

In a preferred embodiment, the composite photosensitive structure includes a rupturable container, retaining an alkaline processing composition and the opacifying agent, fixedly positioned extending transverse a leading edge of the composite structure in order to effect, upon application of compressive pressure to the container, discharge of the processing composition intermediate the opposed surfaces of the reception layer and the next adjacent silver halide emulsion.

The liquid processing composition, distributed intermediate the reception layer and the silver halide emulsion, permeates the silver halide emulsion layers of the composite photosensitive structure to initiate development of the latent images contained therein resultant from photoexposure. As a consequence of the development of the latent images, dye image-providing material associated with each of the respective silver halide emulsion layers is individually mobilized as a function of the point-to-point degree of the respective silver halide emulsion layer's photoexposure, resulting in imagewise distributions of mobile dye image-providing materials adapted to transfer, by diffusion, to the reception layer to provide the desired transfer dye image. Subsequent to substantial dye image formation in the reception layer, means associated with the composite structure are adapted to convert the pH of the film unit from a first processing pH at which dye image-providing material is diffusible as a function of the film unit's photoexposure to a second pH at which the transfer dye image exhibits increased stability, preferably a sufficient portion of the ions of an alkaline processing composition transfers, by diffusion, to a polymeric neutralizing layer to effect reduction in the alkalinity of the composite film unit from a first alkaline processing pH to the second pH at which dye image-providing material is substantially nondiffusible, and further dye image-providing material transfer is thereby substantially obviated.

The transfer dye image is viewed, as a reflection image, through the dimensionally stable transparent layer against the background provided by the opacifying agent, distributed as a component of the processing composition, intermediate the reception layer and next adjacent silver halide emulsion layer. The thus-formed opacifying stratum effectively masks residual dye image-providing material retained in association with the silver halide emulsion layer subsequent to processing.

In U.S. Pat. No. 3,415,644, the dimensionally stable layer of the film unit next adjacent the photosensitive layer or layers is disclosed to be opaque, the opacifying agent is initially disposed in an aqueous alkaline processing composition and the film unit's pH modulating means are disclosed to comprise a polymeric layer disposed intermediate the dimensionally stable transparent layer and the reception layer and adapted to reduce, subsequent to substantial dye transfer image formation, the pH of an aqueous alkaline processing composition from a first processing pH at which the dye image-forming material or materials are soluble and diffusible in the composition as a function of the photoexposure of the photosensitive silver halide layer associated therewith to a second pH at which the dye image-forming material or materials are substantially nondiffusible and, as disclosed in U.S. Pat. No. 3,415,646, the dimensionally stable layer of the film unit next adjacent the photosensitive silver halide layer or layers is disclosed to the transparent to incident actinic radiation and, as further disclosed in U.S. Pat. No. 3,415,645, in such instance the opacifying agent may be initially disposed in the film unit intermediate the reception layer and next adjacent silver halide layer.

As disclosed in U.S. Pat. Nos. 3,615,421 and 3,661,585, the opacifying component of the film unit may optionally be initially disposed as a preformed processing composition permeable layer, intermediate the reception layer and next adjacent silver halide layer, in a concentration which prior to photoexposure is insufficient to prevent transmission therethrough of exposing actinic radiation and which, subsequent to processing, possesses an opacifying capacity effective to mask residual dye image-providing material retained associated with the film unit's silver halide emulsion layers, and in U.S. Pat. No. 3,647,435, the opacifying component of the film unit may optionally be initially formed in situ, intermediate the reception layer and next adjacent silver halide layer, during photographic processing of the film unit.

In U.S. Pat. No. 3,647,437, the opacifying component is disclosed to optionally comprise a light-absorbing reagent such as a dye which is present as an absorbing species at the first pH and which may be converted to a substantially non-absorbing species at the second pH, and in U.S. Pat. Nos. 3,473,925; 3,573,042 and 3,576,626, opacifying and reflecting component, respectively, may be individually interposed intermediate the silver halide layer and reception layer by selective distribution from a composite or a plurality of rupturable containers.

In U.S. Pat. No. 3,573,043, the polymeric neutralizing layer is disclosed to be optionally disposed intermediate the dimensionally stable opaque layer and next adjacent essential layer, i.e., next adjacent silver halide/dye image-providing material component, to effect the designated modulation of film unit's environmental pH; U.S. Pat. No. 3,576,625 discloses the employment of particulate acid distributed within the film unit to effect the modulation of the environmental pH, and U.S. Pat. No. 3,573,044 discloses the employment of processing composition solvent vapor transmissive dimensionally stable layers to effect process modulation of dye transfer as a function of solvent concentration.

Where desired, the film unit may also be constructed in accordance with the disclosure of U.S. Pat. Nos. 3,594,164; 3,594,165; 3,689,262; and 3,701,656, to comprise a composite photosensitive structure including a transparent dimensionally stable layer carrying a reception layer, a processing composition permeable opaque and a photosensitive silver halide layer and the film unit may include a separate dimensionally stable sheet element adapted to be superposed on the surface of the photosensitive structure opposite the dimensionally stable layer and may further include means such as a rupturable container retaining processing composition for distribution of a processing composition intermediate the sheet and photosensitive structure to effect processing. As further disclosed in certain of the last-cited patents, in structures wherein the receptor is positioned next adjacent the transparent layer or the processing composition and/or the sheet is to be separated from the remainder of the film unit subsequent to processing, the latter elements may optionally include opacifying component.

As disclosed in U.S. Pat. No. 3,620,724, the dimensionally stable layer referred to may be opaque and in which instance the photosensitive silver halide layer is positioned next adjacent the opaque support layer and the opacifying component of the film unit's processing composition permeable opaque layer will be disposed in the unit in a concentration insufficient to prevent transmission therethrough of exposing actinic radiation and which, subsequent to processing, processes an opacifying capacity effective to mask residual dye image-providing material retained associated with the silver halide layer, and as disclosed in U.S. Pat. No. 3,647,434, the opacifying agent may be optionally formed in such film unit, in situ, during processing of the unit.

In U.S. Pat. No. 3,188,209, it is disclosed that the respective selectively sensitive silver halide and dye image-providing material units of multichromatic diffusion transfer process film units may comprise a construction employing disposition of the dye image-providing material in a silver halide free layer intermediate two separate contiguous silver halide layers of uniform spectral sensitivity and a construction employing disposition of the dye image-providing material in a selectively sensitized silver halide layer in combination with a separate contiguous silver halide layer of the same spectral sensitivity positioned next adjacent the film unit support.

SUMMARY OF THE INVENTION

The present invention is directed to a new and improved diffusion transfer process photographic film unit adapted to provide, by diffusion transfer processing, photographic color image reproduction as a function of exposure of such film unit to incident actinic radiation.

The film unit assemblage construction to be employed in the practice of the present invention may comprise a film of the general type set forth in aforementioned U.S. Pat. Nos. 3,415,644; 3,415,645; 3,415,646; 3,473,925; 3,573,042; 3,573,043; 3,573,044; 3,576,625; 3,576,626; 3,594,164; 3,594,165; 3,615,421; 3,620,724; 3,647,434; 3,647,435; 3,647,437; 3,661,585; 3,672,890; and 3,689,262; copending U.S. patent application Ser. No. 159,254 (now U.S. Pat. No. 3,689,262 issued Sept. 5, 1972); and in U.S. Pat. Nos. 2,983,606; and 3,345,163; and copending U.S. patent application Ser. No. 262,332, filed June 13, 1972 (now U.S. Pat. No. 3,778,265 issued Dec. 11, 1973), and will contain a plurality of layers including, in relative order, a dimensionally stable layer preferably opaque to incident actinic radiation; one or more composite photosensitive units each exhibiting a predetermined gamma of substantially the same value and within a range of 1.1 to 1.7. Each photosensitive unit includes a first photosensitive silver halide layer which comprises a particulate dispersion of silver halide, preferably silver iodobromide, iodochloride or iodochlorobromide grains and a diffusion process dye image-forming material possessing a spectral absorption within the spectral range to which the silver halide is sensitive and exhibits a first gamma value greater than the predetermined gamma value of the unit. The photosensitive unit further includes a second layer comprising a particulate dispersion of photosensitive silver halide which is substantially free of diffusion transfer process dye image-forming material and exhibits a second gamma differing from the said first gamma by a value of at least about 0.25, the value of said first and second gammas being within the range of 1.7 to 3.0. In the first layer, the dye image-forming material and silver halide dispersion are present in amounts effective to establish a diffusion transfer speed separation between the first and second layers having the equivalence of greater than or equal to one and less or equal to seven stops. The second layer is positioned intermediate the exposure surface of the film unit and the first layer. A receptor arrangement is provided for receiving diffusion transfer process dye image-forming material diffusing thereto as a function of the point-to-point degree of the photosensitive units' exposure to incident actinic radiation.

For an integral film unit structure, the receptor arrangement preferably comprises a layer adapted to receive image-forming material diffusing thereto as a function of the point-to-point degree of silver halide layer exposure to incident actinic radiation and a dimensionally stable layer transparent to incident actinic radiation. Additionally, the integral unit will include means for interposing, intermediate the silver halide layers and the reception layer, opacifying agent; and means for providing a processing composition in contact with the photosensitive layers, and, in a particularly preferred embodiment, a processing composition possessing a first pH at which the diffusion transfer process dye image-forming material is diffusible during processing and means for modulating the pH of the film unit from the first pH to a second pH at which the dye image-forming material is substantially nondiffusible subsequent to substantial dye transfer image formation.

Depending upon the speed separation desired, the mean diameter of the silver halide dispersion within the layers of a noted unique composite photosensitive unit may be varied. By incorporating a finer mean grain size within that layer combined with dye image-forming material, broader equivalent speed separation may be realized. Further, by virtue of the high covering power stemming from the greater surface of a smaller grain dispersion, improved diffusion transfer process dye transfer control is availed.

In accordance with a specifically preferred embodiment of the present invention, a film unit assemblage of the aforementioned general structural parameters will be adapted to be processed, subsequent to photoexposure, in the presence of actinic radiation and may be fabricated to employ, as means interposed intermediate the reception layer and next adjacent silver halide layer subsequent to photo-exposure, an inorganic light-reflecting pigment dispersion containing reflecting pigment and at least one optical filter agent, at a pH above the pKa of the optical filter agent and at which pH the dye image-forming material is diffusible during processing as a function of silver halide layer photoexposure, in a concentration in admixture effective to provide a barrier to transmission of actinic radiation therethrough, and the means for interposing the opacifying agent and the processing composition may comprise a rupturable container, retaining the opacifying agent disposed in the processing composition selected, fixedly positioned extending transverse a leading edge of the film unit and adapted, upon application of compressive pressure, to distribute its contents intermediate the reception layer and next adjacent silver halide layer.

Film units structured in accordance with the invention are found to exhibit diffusion transfer characteristic curves evidencing desirably broadened dynamic range and toe extent. These characteristic curves also evidence gamma values lying within a desirable range.

BRIEF DESCRIPTION OF THE DRAWINGS

FIGS. 2, 4 and 6 are diagrammatic enlarged cross-sectional views of the film unit of FIG. 1, along section line 2—2, illustrating the association of elements during the three illustrated stages of the performance of a diffusion transfer process, for the production of a multicolor transfer image, according to the invention, the thickness of the various materials being exaggerated, and wherein FIG. 2 represents an exposure stage, FIG. 4 represents a processing stage and FIG. 6 represents a product of the process;

DETAILED DESCRIPTION OF THE INVENTION

Figure 1:
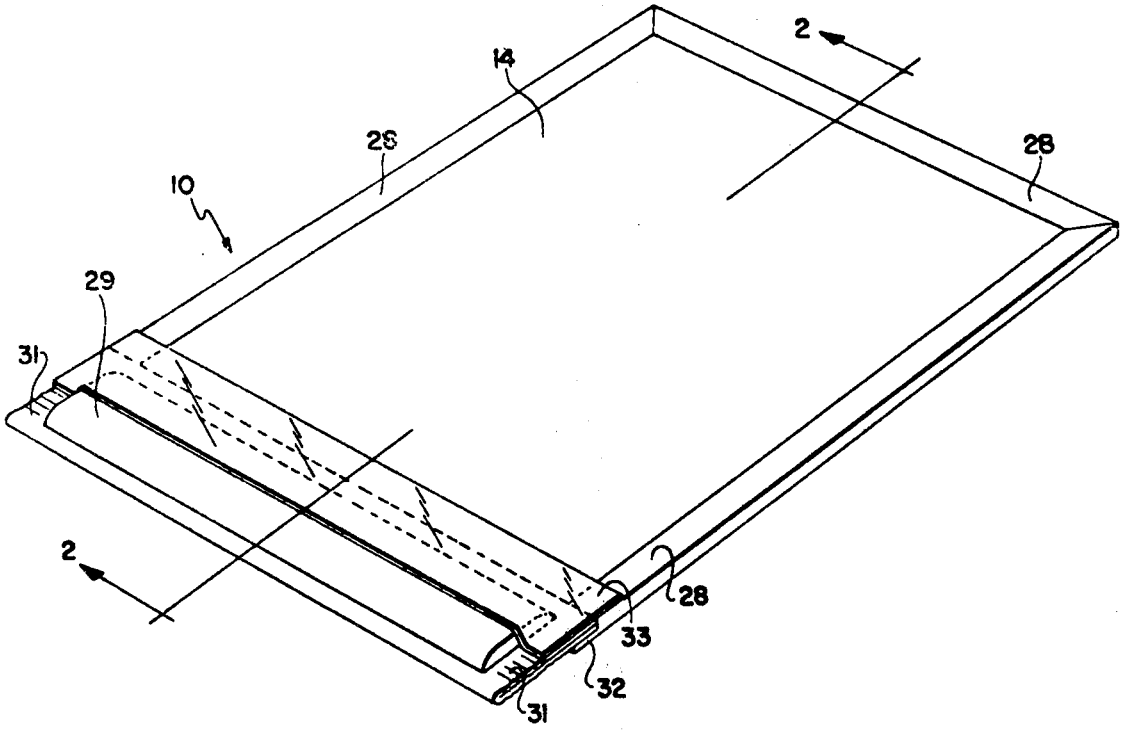
FIG. 1 is a perspective view of a photographic film unit embodying the invention.

As previously characterized, diffusion transfer photographic processing may be employed to provide a positive reflection dye image, as a direct function of actinic radiation incident on a film unit assemblage which unit is preferably constructed to comprise a plurality of sequential layers including a dimensionally stable layer most preferably opaque to incident radiation; a photosensitive silver halide layer having associated therewith dye image-forming material which is processing composition diffusible at a selected first pH as a function of the point-to-point degree of silver halide layer photoexposure; a layer adapted to receive dye image-forming material diffusing thereto; a dimensionally stable layer transparent to incident radiation; means for interposing, intermediate the silver halide layer and the reception layer, opacifying agent, preferably an inorganic reflecting pigment dispersion containing at least one optical filter agent or dye, in a concentration effective to provide, subsequent to selective photoexposure of the silver halide layer, protective of the silver halide layer from further exposure to actinic radiation incident on the dimensionally stable layer; and means for converting the pH of the film unit from the first processing pH to a second pH at which the dye image-forming material is substantially nondiffusible subsequent to substantial dye image-forming material diffusion to the reception layer.

It now has been discovered, however, that improved photographic reproduction in color by diffusion transfer processing may be accomplished by employment of a diffusion transfer process film unit which includes one or more composite photosensitive units of unique configuration. These unique photosensitive units comprise a first layer containing a particulate dispersion of photosensitive silver halide, preferably silver iodobromide, iodochloride or iodochlorobromide, and a diffusion transfer process dye image-forming material possessing spectral absorption within the spectral range to which the silver halide is sensitive. The photosensitive unit further includes a second layer comprising a particulate dispersion of photosensitive silver halide and is substantially free of diffusion process dye image-forming material. Each noted layer, respectively, exhibits first and second gamma values which differ from each other by at least about 0.25, but fall within a range of 1.7 to 3.0. Each of the plurality of photosensitive units of the film unit exhibits a predetermined gamma of substantially the same value and within a range of 1.1 to 1.7. However, the noted first and second gamma values of the respective first and second layers of the unique composite unit structure exhibit gamma values greater than the predetermined gamma value of each photosensitive unit. Further, the dye image-forming material and silver halide dispersion of the noted first layer of the unique photosensitive unit are present in an amount effective to establish a diffusion transfer speed separation between the noted first and second layers having the equivalence of greater than or equal to 1 and less than or equal to 7 stops.

As is known in the art, gamma values are determined from the characteristic curve of the dye transfer image and are measured as the gradient or rate of change between specified intercepts of the curve. Speed also may be derived from the characteristic curve as a value representing reciprocal of the exposure required to produce a predetermined result. Accordingly, speed may be determined by finding the curve intercept for a specified sample density level and noting the corresponding log relative exposure or exposure wedge density, as the case may be.

In one embodiment, the film unit structure also will include a layer adapted to receive dye image-providing material diffusing thereto, as a function of the point-to-point degree of the photosensitive layers' exposure to incident actinic radiation.

In one preferred structure of the invention, the noted first layer of the unique photosensitive unit is formed of silver halide grains which possess a mean particle size smaller than the mean particle size of the silver halide grains present within the second layer. Further, it is preferred that the noted second layer be positioned intermediate the exposure surface of the film unit and the noted first layer.

In a preferred embodiment of the present invention, the silver halide grains, most preferably silver iodobromide, iodochloride and/or iodochlorobromide grains, comprising the first and second layers possess a mean grain size distribution within the range of about 0.2 to 3.0 $\mu$ and, most preferably, within the range of about 0.5 to 2.0 $\mu$.

Employment of diffusion transfer color process film units possessing the defined composite photosensitive silver halide components has been discovered, per square unit coverage of silver halide, to provide increased diffusion transfer process exposure latitude or dynamic range; increased Diffusion Transfer Process Exposure Index; and more efficient and effective utilization of silver, dye image-providing components and photographic adjuvants as, for example, sensitizing dye components of the film unit.

Specifically, the employment of the denoted composite photoresponsive units have been found to enhance the dye diffusion control aspects of the dye transfer process with its concomitant improvement in transfer dye image acuity and resolution, and, in multicolor dye transfer processes, improved dye image separation and segregation, without sacrifice of desired film unit sensitometry characteristics.

In particular it has been discovered, in contradistinction to conventional photosensitive silver halide dye image-forming construction of the art, that if a color diffusion transfer process film unit is constructed as detailed herein whereby a one to seven stops equivalent speed separation between the noted layers of select photosensitive units is provided without resort to the use of extreme silver halide grain sizes which would tend to lose sensitivity in small sizes and develop fogging effects in large sizes, whereby the gamma values of these two layers is greater than the substantially equal gamma values of each photosensitive unit of the film unit, and whereby the noted photosensitive unit layers exhibit a separation in respective gamma values amounting to at least about 0.25 and whereby in a preferred embodiment, the noted layer which contains dye image-forming material incorporates a relatively smaller grain construction and possesses high covering power by reason of its limited particle size and increased surface area, then it is possible to achieve the high speed and sensitivity of a large grain photosensitive silver halide composition in viable combination with the optimized diffusion transfer process dye image control conversant with the employment of a slow speed, low sensitivity photosensitive formulation directly retaining dye image-forming material and required for optimum dye transfer control, separation and dye image acuity.

In particularly preferred embodiments of the present invention the first and second photosensitive silver halide layer will each comprise a mixed halide of the type discussed above and the photosensitive silver halide will ordinarily be employed at an overall coverage of about 40 to 200 mgs./ft.$^2$, most preferably the first photosensitive layer at a coverage of about 20 to 100 mgs./ft.$^2$ and the second photosensitive layer at a coverage of about 20 to 100 mgs./ft.$^2$, in combination with a selected diffusion transfer process dye image-providing material present in a ratio of about 1.5 to 0.4 dye to photosensitive silver halide, e.g., about 30 to 150 mgs./ft.$^2$ dye to photosensitive silver halide disposed at the coverage stated above.

The preferred silver iodochlorobromide, iodochloride and iodobromide type photosensitive layers employed for the fabrication of the photographic film unit, may be prepared by reacting a water-soluble silver salt, such as silver nitrate, with at least one water-soluble halide, such as ammonium, potassium or sodium chloride, together with corresponding iodide and bromide, or ammonium, potassium or sodium bromide, together with corresponding iodide, in an aqueous solution of a peptizing agent such as colloidal gelatin solution; digesting the dispersion at an elevated temperature, to provide increased crystal growth; washing the resultant dispersion to remove undesirable reaction products and residual water-soluble salts, for example, employing the preferred gelatin matrix material, by chilling the dispersion, noodling the set dispersion, and washing the noodles with cold water, or alternatively, employing any of the various flocc systems, or procedures, adapted to effect removal of undesired components, for example, the procedures described in U.S. Pat. Nos. 2,614,928; 2,614,929; 2,728,662, and the like; after-ripening the dispersion at an elevated temperature in combination with the addition of gelatin or such other polymeric material as may be desired and various adjuncts, for example, chemical sensitizing agents of U.S. Pat. Nos. 1,574,944; 1,623,499; 2,410,689; 2,597,856; 2,597,915; 2,487,850; 2,518,698; 2,521,926; and the like; all according to the traditional procedures of the art, as described in Neblette, C. B., *Photography Its Materials and Processes*, 6th Ed., 1962.

Optical sensitization of the emulsion's silver halide crystals may be accomplished by contact of the emulsion composition with an effective concentration of the selected optical sensitizing dyes dissolved in an appropriate dispersing solvent such as methanol, ethanol, acetone, water, and the like; all according to the traditional procedures of the art, as described in Hammer, F. M., *The Cyanine Dyes and Related Compounds*.

Additional optional additives, such as coating aids, hardeners, viscosity-modifying agents, stabilizers, preservatives, and the like, for example, those set forth hereinafter, also may be incorporated in the emulsion formulation, according to the conventional procedures known in the photographic emulsion manufacturing art.

As the binder for the photoresponsive material, the aforementioned gelatin may be, in whole or in part, replaced with some other natural and/or synthetic processing composition permeable polymeric material such as albumin; casein; or zein or resins such as cellulose derivative, as described in U.S. Pat. Nos. 2,322,085 and 2,541,474; vinyl polymers such as described in an extensive multiplicity of readily available U.S. and foreign patents or the photo-responsive material may be present substantially free of interstitial binding agent as described in U.S. Pat. Nos. 2,945,771;

3,145,566; 3,142,567; Newman, *Comment on Non-Gelatin Film*, B. J. O. P., 434, Sept. 15, 1961; and Belgian Pat. Nos. 642,557 and 642,558.

Specifically, a preferred silver iodobromide emulsion may be readily formulated by a conventional single jet addition, over a period of 40 minutes, at a rate of 10 liters per minute from the jet, a solution comprising 3 M. silver nitrate, in distilled water, at room temperature, into a solution comprising 3 M. alkali halide (e.g. potassium) possessing 98% bromide and 2% iodide in trimellitic acid anhydride derivatized acid pig gelatin, at room temperature, preadjusted to pH 6 with 5% potassium hydroxide. The resultant silver iodobromide emulsion is held subsequent to formulation for the period of time required to provide the selected silver halide grain size distribution and separation of the siler iodobromide-trimellitic acid anhydride derivatized gelatin precipitate provided by the addition of 2 N. sulfuric acid to the reaction mixture. The resultant precipitate is washed with chilled distilled water until the wash water exhibits a conductivity of about 300 to 500 $\mu$ mhos/cm, the volume adjusted with distilled water for the addition of 100 gms. of lime bone gelatin per 1000 cc. of emulsion, chemically sensitized at about 56° C., pH 5 and pAg 9, by the addition of a sensitizing amount of a solution containing 0.1 gram of ammonium thiocyanate in 9.9 cc. of water and 1.2 cc. of a solution containing 0.097 gram of gold chloride in 9.9 cc. of water, and a 0.02% aqueous sodium thiosulfate solution optimized for the mean silver halide iodide crystal concentration, and the emulsion then afterripening for 3 hours at a temperature of 60° C. and a pH of 5.5.

In preferred embodiments of the present invention, the composite photosensitive silver halide emulsions employed will be emulsions adapted to provide a Diffusion Transfer Process Exposure Index > about 50, which Index indicates the correct exposure rating of a diffusion transfer color process at which an exposure meter, calibrated to the ASA Exposure Index, must be set in order that it give correct exposure data for producing color transfer prints of satisfactorily high quality. The diffusion Transfer Process Exposure Index is based on a characteristic H & D curve, which as above described, relates original exposure of the composite photo-sensitive silver halide emulsions to the respective curve densities forming the resultant transfer image. Thus, the Diffusion Transfer Exposure Index is based on the exposure to which the silver halide emulsions, for use in color diffusion transfer processes, must be subjected in order to obtain an acceptable color transfer image by that process and is a direct guide to the exposure setting to be entered in a camera in order to obtain proper exposure of the film unit.

In accordance with the present invention, it has also been discovered that excellent diffusion transfer dye image characteristic curve shape control, i.e., control of the transfer image characteristics represented graphically by the curve integrating dye density of the transfer image as a function of the log exposure of the photosensitive silver halide layer, may be obtained by utilization of the composite photosensitive silver halide layer structure of the present invention and most expeditiously by utilization of a first photosensitive silver halide layer which comprises a blend of differentially photosensitive silver halide dispersions at least one of the dispersions comprising the silver iodochlorobromide, iodochloride and/or iodobromide dispersions described above in admixture, for example, with a second, etc., silver chlorobromide, -bromide, or preferably, -iodobromide, -iodochloride or -iodochlorobromide dispersion or dispersions formulated as detailed herein, which blend preferably possesses a mean particule size within the previously denoted range of about 0.2 to 3.0 $\mu$.

Specifically, upon blending the aforementioned differentially sensitive silver halide dispersions, the characteristic curve of the dye transfer image resultant from employment of the blend assumes the "shoulder", i.e., low photosensitive silver halide layer photoexposure region, "speed", i.e., relative measurement defined as a value representing the reciprocal of the exposure required to produce a predetermined result, of the fastest silver halide dispersion and the "toe", i.e., high photosensitive layer photoexposure region, "speed" of the slowest silver halide dispersion, thus increasing the exposure latitude range and lowering the resultant slope or gamma of the curve.

There is thus provided the capacity for controlled formulation of photosensitive layers exhibiting a selectively extended range of predetermined gammas or contrasts and "exposure latitudes" or "dynamic ranges", i.e., the relative measurement of the range of exposure from which a useful dye transfer image may be derived; the instant invention thereby providing the capability of a high maximum density, low minimum density and extended dynamic range dye diffusion transfer imaging system and thus adapted to more advantageously reproduce, as dye transfer image differences, the luminance differences existing in an object to be photographically reproduced, including optimization of the minimum useful exposure required to reproduce minimum differences existing in the shadow regions of the object to be reproduced by means of some minimum density differences in resultant dye transfer image conformation.

In a preferred embodiment of the present invention, the means for interposing the processing composition selected intermediate the reception layer and the next adjacent silver halide layer comprises a rupturable container retaining a processing composition comprising the solvent and pH concentrations required fixedly positioned and extending transverse a leading edge of the film unit to effect, upon application of compressive pressure, discharge of the processing composition intermediate the reception layer and the photosensitive silver iodochlorobromide layer next adjacent. In such embodiment the opacifying agent is preferably disposed within the processing composition, as retained in the rupturable container, for distribution as a component of such composition intermediate the reception and silver halide layers, subsequent to selective exposure of the film unit.

Multicolor images be obtained using color image-forming components in the diffusion transfer process of the present invention by several techniques. One such technique contemplates obtaining multicolor transfer images utilizing, for example, dye developers as dye image-providing materials by employment of an integral multilayer photosensitive element, such as is disclosed in aforementioned U.S. Pat. No. 3,415,644 wherein at least two selectively sensitized photosensitive strata, superposed on a single support, are processed, simultaneously and without separation, with a single, common image-receiving layer. A suitable arrangement of this type comprises the opaque support carrying a red-sensitive silver halide unit, a green-sensitive silver halide unit and a blue-sensitive silver halide unit, said silver halide units having associated therewith, respectively, for example, a cyan dye developer, a magenta dye developer and a yellow dye developer, wherein at least one of the respective units comprises a composite structure in accordance with the present invention and the dye developer associated with that unit is disposed in the unit's second silver halide stratum. The remaining dye developers may be utilized in their respective silver halide strata, for example, in the form of particles, or may be disposed as a layer behind the appropriate silver halide strata. Each set of silver halide units including associated dye developer are disclosed to be optionally separated from other sets by suitable interlayers, for example, by a layer of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be employed. In such instances, a separate yellow filter may be omitted.

In a preferred embodiment of the present invention, the film unit is specifically adapted to provide for the production of a multicolor dye transfer image and the photo-sensitive laminate comprises, in order of essential layers, the dimensionally stable opaque layer; at least two selectively sensitized siler halide units each having dye image-providing material of predetermined color associated therewith, with, for example, dye developers as detailed above, which are soluble and diffusible in processing composition as a function of the point-to-point degree of exposure of the respective associated silver halide strata; a polymeric layer dyeable by the dye image-providing materials; and a dimensionally stable transparent layer, and at least one selectively sensitized silver halide unit comprises a composite structure in accordance with the present invention.

In view of the fact that the preferred dye image-providing materials comprise dyes which are silver halide developing agents, as stated above, for purposes of simplicity and clarity, the present invention will be further described hereinafter in terms of such dyes, without limitation of the invention to the illustrative dyes denoted, and, in addition the photographic film unit structure will be detailed hereinafter employing the last-mentioned preferred structural embodiment, without limitation of the invention to the preferred structure denoted.

The dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

The dye developers are preferably selected for their ability to provide colors that are useful in carrying out subtractive color photography, that is, the previously mentioned cyan, magenta and yellow. The dye developers employed are incorporated in the respective silver halide emulsion for the composite photosensitive unit described. Other units may include the dye developer in a separate layer behind the respective silver halide stratum. Specifically, the dye developer may, for example, be in a coating or layer behind the respective silver halide stratum and such a layer of dye developer may be applied by use of a coating solution of the respective dye developer distributed in a film-forming natural, or synthetic, polymer, for example, gelatin, polyvinyl alcohol, and the like, adapted to be permeated by the chosen diffusion transfer fluid processing composition.

The silver units comprising the multicolor photo-sensitive laminate preferably possess predominant spectral sensitivity to separate regions of the spectrum and each has associated therewith a dye which is a silver halide developing agent and is, most preferably, substantially soluble in the reduced form only at a first pH possessing subsequent to processing, a spectral absorption range substantially complementary to the predominant sensitivity range of its associated emulsion. By incorporating the dye with the second silver halide layer of a composite photosensitive unit, a modulation of the noted predominant spectral sensitivity thereof is realized. This modulation lends to the desired speed separation between the silver halide layers of the unit.

In the preferred embodiment, each of the silver halide strata, and its associated dye, is separated from the remaining strata, and their associated dye, by separate alkaline solution permeable polymeric interlayers.

In such preferred embodiment of the invention, the silver halide strata most preferably comprise a first silver halide layer including photosensitive silver iodochlorobromide and/or iodobromide grains dispersed in gelatin and are about 0.6 to 6 $\mu$ in thickness; a second silver halide layer including silver halide and the dye itself is dispersed in an aqueous alkaline solution polymeric binder, preferably gelatin, as a separate layer about 1 to 7 $\mu$ in thickness; the alkaline solution permeable polymeric interlayers, preferably gelatin, are about 1 to 5 $\mu$ in thickness; the dyeable polymeric layer is transparent and about 0.25 to 0.4 mil. in thickness; and each of the dimensionally stable opaque and transparent layers are alkaline solution impermeable, processing composition vapor permeable and about 2 to 6 mils. in thickness. It will be specifically recognized that the relative dimensions recited above may be appropriately modified, in accordance with the desires of the operator, with respect to the specific product to be ultimately prepared.

Although in one embodiment of the present invention, the dimensionally stable layers employed in the practice of the invention may possess a vapor transmission rate of 1 or less gms./24 hrs. 100 in.$^2$/mil., in a preferred embodiment of the invention, the layers employed will possess a vapor transmission rate for the selected processing composition solvent averaging not less than about 100 gms./24 hrs./100 in.$^2$/mil., most preferably in terms of the preferred solvent, water, a vapor transmission rate averaging in excess of about 300 gms. of water/24 hrs./100 in.$^2$/mil., and may advantageously comprise a microporous polymeric film possessing a pore distribution which does not unduly interfere with the dimensional stability of the layers or, where required, the optical characteristics of such layers. Such pore distribution may comprise, for example, an average pore diameter of from < about 20 $\mu$ to > about 100 μ and a pore volume of < about 3% to > about 7%.

In a particularly preferred embodiment of the present invention, the preferred solvent, water, may be employed in a weight/weight ratio of about 1:10 to 1:25 dye to water at a ratio of about 1:3 to 1:10 liquid permeable polymer to water and most preferably will be fabricated to comprise about 300 to 1300 mgs./ft.$^2$ liquid permeable polymeric binder material, about 200 to 400 mgs./ft.$^2$ dye and about 5000 mgs./ft.$^2$ water.

The preferred dimensionally stable layers are designed so that there is no liquid flow through the layers while allowing the vapor of the processing composition solvent to pass by diffusion from the evaporating liquid body and the operational efficiency of the film unit is directly dependent upon the nature and quality of the vapor permeable membrance characteristics of the layers selected. The vapor transmission characteristics desired are directed to maximization of the rate at which the required quantity of processing solvent is effectively evacuated from the film unit subsequent to substantial dye transfer image formation by diffusion transfer processing, commensurate with maintaining the liquid impermeability and dimensional stability characteristics of the layers. Thus, the layers should possess the maximum vapor transmission capacity which permits the passage of processing composition solvent vapor, and any gas dissolved therein, at its vapor pressure, without allowing passage of fluid processing composition. The layers employed in accordance with the present invention therefor should be as thin as possible for solvent vapor transmission efficiency yet retain sufficient strength to provide stability to and resist chemical and physical degradation of the film unit under conditions of use.

In the preferred embodiment of the present invention's film unit for the production of a multicolor transfer image, the respective silver halide/dye developer units of the photosensitive element will be in the form of a tripack configuration which will ordinarily comprise a cyan dye developer/red-sensitive emulsion unit contiguous the dimensionally stable obaque layer, the yellow dye developer/blue-sensitive emulsion unit most distant from the opaque layer and the magenta dye developer/green-sensitive emulsion unit intermediate those units, recognizing that the relative order of such units may be varied in accordance with the desires of the operator.

Reference is now made to FIGS. 1 through 7 of the drawings wherein there is illustrated a preferred film unit of the present invention and wherein like numbers, appearing in the various figures, refer to like components.

As illustrated in the drawings, FIG. 1 sets forth a perspective view of the film unit, designated 10, and each of FIGS. 2 through 7 illustrate diagrammatic cross-sectional views of film unit 10, along the stated section lines 2—2, 3—3, 5—5 and 7—7, during the various depicted stages in the performance of a photographic diffusion transfer process as detailed hereinafter.

Film unit 10 comprises rupturable container 11, retaining, prior to processing, aqueous processing composition 12, and photosensitive laminate 13 including, in order, dimensionally stable obaque layer 14, preferably an actinic radiation-opaque flexible sheet material; red-sensitive silver halide cyan dye developer layer 15; red-sensitive silver iodochlorobromide, iodochloride and/or iodobromide emulsion layer 16 possessing the parameters denoted above; interlayer 17; green-sensitive silver halide magenta dye developer layer 18; green-sensitive silver iodochlorobromide, iodochloride and/or iodobromide emulsion layer 19 possessing the parametes denoted above; interlayer 20; blue-sensitive silver halide yellow dye developer layer 21; blue-sensitive silver iodochlorobromide, iodochloride and/or iodobromide emulsion layer 22 possessing the parameters denoted above; auxiliary layer 23, which may contain an auxiliary silver halide developing agent; image-receiving layer 24; spacer layer 25; neutralizing layer 26; and dimensionally stable transparent layer 27, preferably an actinic radiation transmissive flexible sheet material.

The structural integrity of laminate 13 may be maintained, at least in part, by the adhesive capacity exhibited between the various layers comprising the laminate at their opposed surfaces. However, the adhesive capacity exhibited at an interface intermediate image-receiving layer 24 and the silver iodochlorobromide, iodochloride and/or iodobromide emulsion layer next adjacent thereto, for example, image-receiving layer 24 and auxiliary layer 23 as illustrated in FIGS. 2 through 7, should be less than that exhibited at the interface between the opposed surfaces of the remainder of the layers forming the laminate, in order to facilitate distribution of processing solution 12 intermediate the stated image-receiving layer 24 and the silver iodochlorobromide, iodochloride and/or iodobromide emulsion layer next adjacent thereto. The laminate's structural integrity may also be enhanced or provided, in whole or in part, by providing a binding member extending around, for example, the edges of laminate 13, and maintaining the layers comprising the laminate intact, except at the interface between layers 23 and 24 during distribution of processing composition 12 intermediate those layers. As illustrated in the figures, the binding member may comprise a pressure-sensitive tape 28 securing and/or maintaining the layers of laminate 13 together at its respective edges. Tape 28 will also act to maintain processing solution 12 intermediate image-receiving layer 24 and the silver iodochlorobromide, iodochloride and/or iodobromide emulsion layer next adjacent thereto, upon application of compressive pressure to pod 11 and distribution of its contents intermediate the stated layers. Under such circumstances, binder tape 28 will act to prevent leakage of fluid processing composition from the film unit's laminate during and subsequent to photographic processing.

Rupturable container 11 may be of the type shown and described in any of U.S. Pat. Nos. 2,543,181; 2,634,886; 3,653,732; 2,723,051; 3,056,492; 3,056,491; 3,152,515; and the like. In general, such containers will comprise a rectangular blank of fluid- and air-impervious sheet material folded longitudinally upon itself to form two walls 29 which are sealed to one another along their longitudinal and end margins to form a cavity in which processing composition 12 is retained. The longitudinal marginal seal 30 is made weaker than the end seals 31 so as to become unsealed in response to the hydraulic pressure generated within the fluid contents 12 of the container by the application of compressive pressure to walls 29 of the container.

Figure 2:
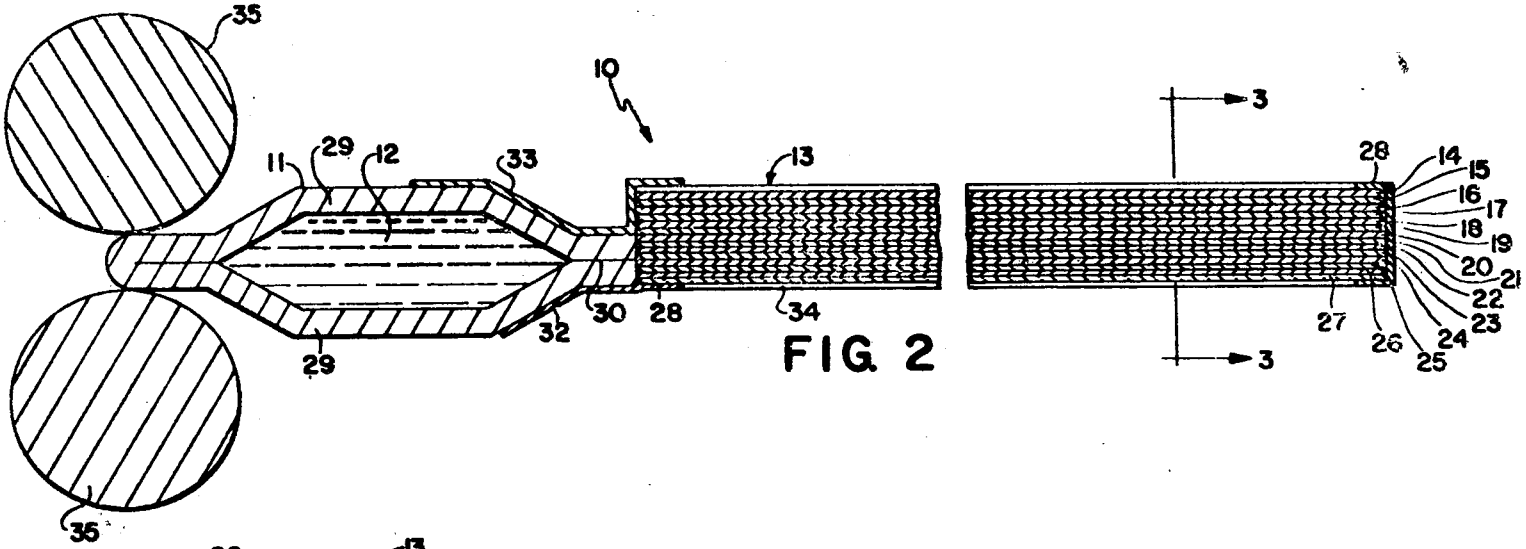
Figure 3:
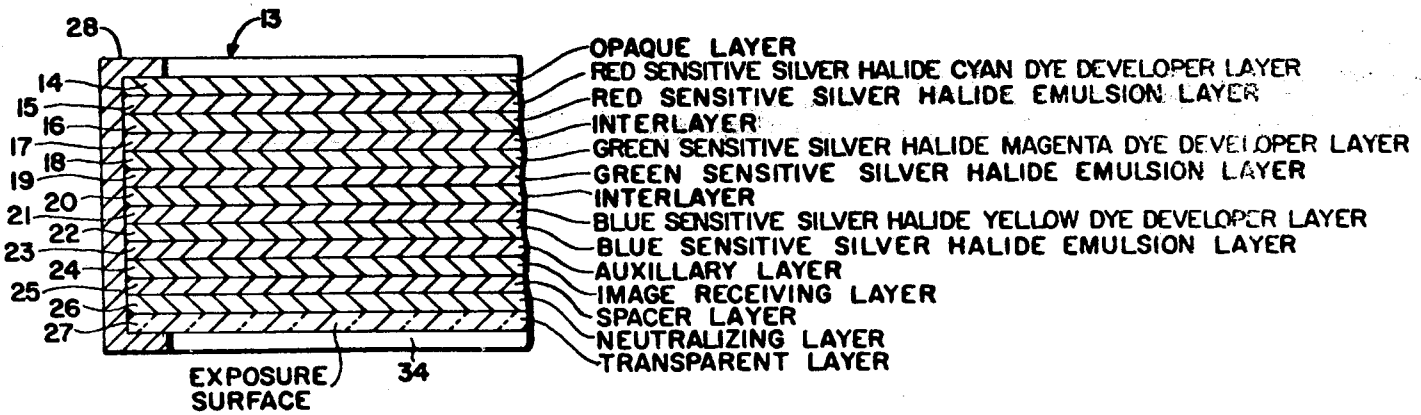
FIGS. 3, 5 and 7 are diagrammatic, further enlarged cross-sectional views of the film unit of FIGS. 2, 4 and 6. along section lines 3—3, 5—5 and 7—7, respectively, further illustrating, in detail, the arrangement of layers comprising the photosensitive laminate during the three illustrated stages of the transfer process.
Figure 4:
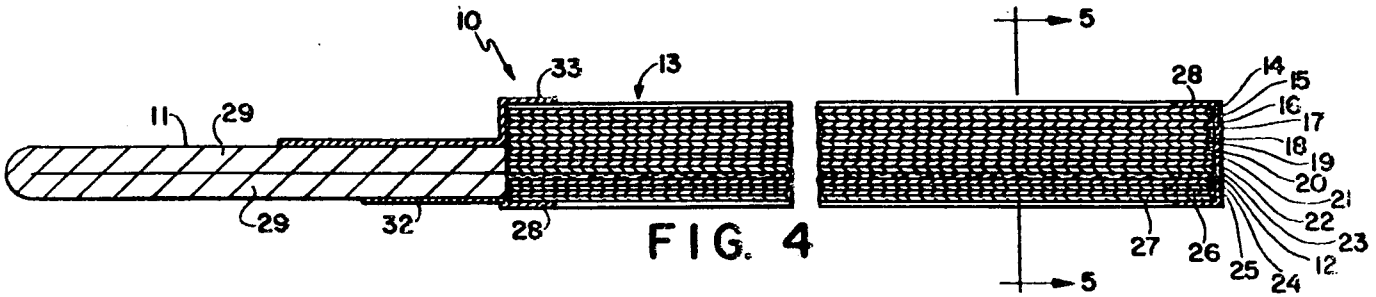
Figure 5:
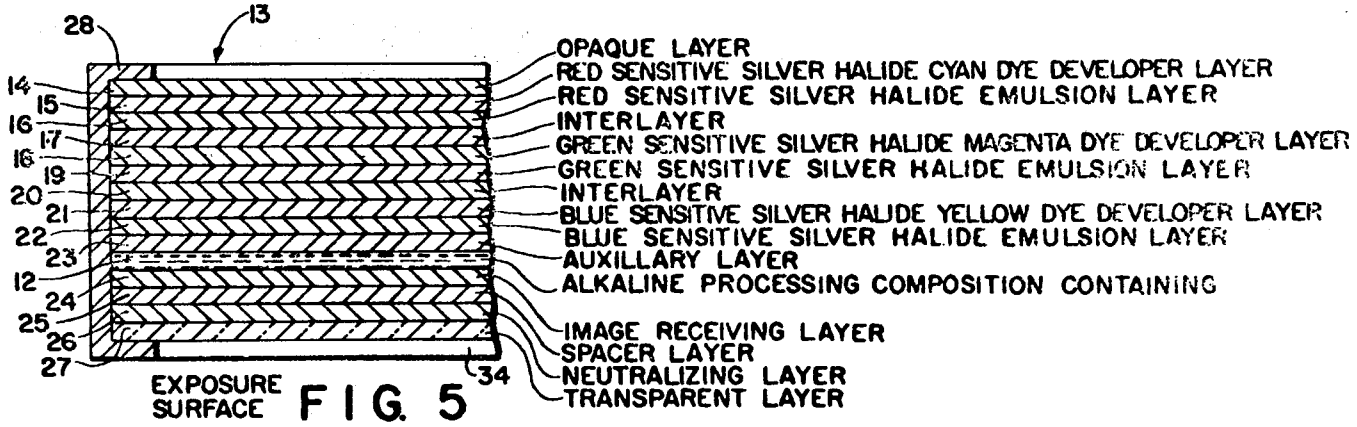
Figure 6:
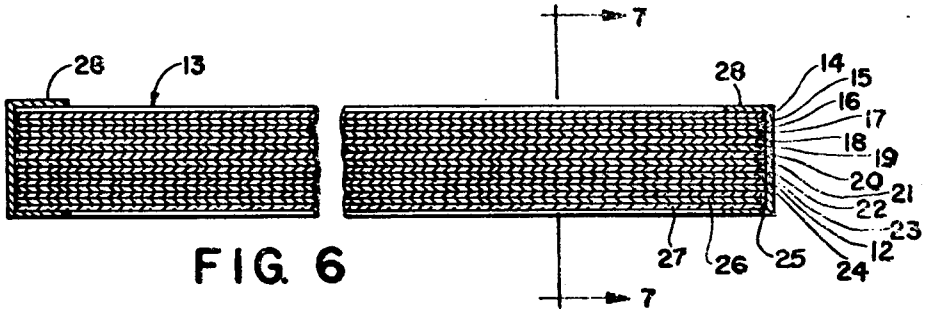
Figure 7:
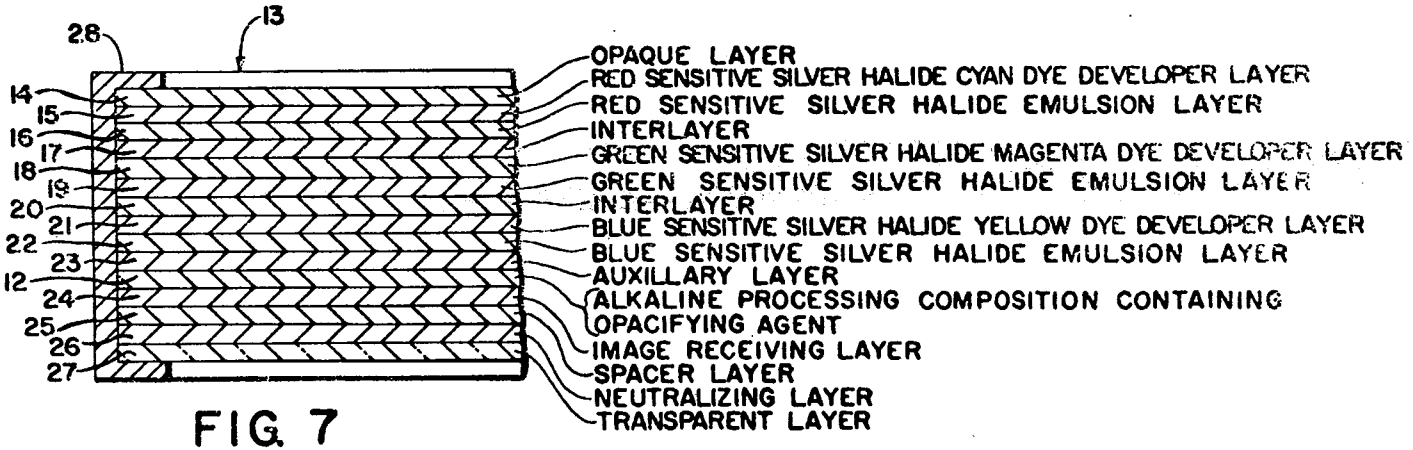

As illustrated in FIGS. 1, 2 and 3, container 11 is fixedly positioned and extends transverse a leading edge of photosensitive laminate 13 whereby to effect unidirectional discharge of the container's contents 12 between image-receiving layer 24 and the stated layer next adjacent thereto, upon application of compressive force to container 11. Thus, container 11, as illustrated in FIG. 2, is fixedly positioned and extends transverse a leading edge of laminate 13 with its longitudinal marginal seal 30 directed toward the interface between image-receiving layer 24 and auxiliary layer 23. As shown in FIGS. 1, 2 and 4, container 11 is fixedly secured to laminate 13 by extension 32 of tape 28 extending over a portion of one wall 29 of the container, in combination with a separate retaining member such as illustrated retaining tape 33 extending over a portion of laminate 13's surface generally equal in area to about that covered by tape 28.

As illustrated in FIGS. 1, 2 and 4, extension flap 32 of tape 28 is preferably of such area and dimensions that upon, for example, manual separation of container 11 and tape 33, subsequent to distribution of processing composition 12, from the remainder of film unit 10, flap 32 may be folded over the edge of laminate 13, previously covered by tape 33, in order to facilitate maintenance of the laminate's structural integrity, for example, during the flexations inevitable in storage and use of the processed film unit, and to provide a suitable mask or frame, for viewing of the transfer image through the picture viewing area of transparent layer 27.

The fluid contents of the container preferably comprise an aqueous alkaline solution having a pH and solvent concentration at which the dye developers are soluble and diffusible and contains inorganic light-reflecting pigment and at least one optical filter agent at a pH above the pKa of such agent in a quantity sufficient, upon distribution, effective to provide a layer exhibiting optical transmission density > about 6.0 and optical reflection density < about 1.0 to prevent exposure of photosensitive silver emulsion layers 15, 16, 18, 19, 21 and 22 by actinic radiation incident on dimensionally stable transparent layer 27 during processing in the presence of such radiation and to afford immediate viewing of dye image formation in image-receiving layer 24 during and subsequent to dye transfer image formation. Accordingly, the film unit may be processed, subsequent to distribution of the composition, in the presence of such radiation, in view of the fact that the silver halide or emulsions of laminate are appropriately protected by incident radiation, at one major surface of the opaque processing composition and at the remaining major surface by the dimensionally stable opaque layer. If the illustrated binder tapes are also opaque, edge leakage of actinic radiation incident on the emulsion or emulsions will also be prevented.

The selected reflecting pigment should be one providing a background suitable for viewing the dye developer transfer image formed in the dyeable polymeric layer. In general, while substantially any reflecting agent may be employed, it is preferred that a reflecting agent be selected that will not interfere with the color integrity of the dye transfer image, as viewed by the observer, and, most preferably, an agent which is aesthetically pleasing to the viewer and does not provide a background noise signal degrading, or detracting from, the information content of the image. Particularly desirable reflecting agents will be those providing a white background, for viewing the transfer image, and specifically those conventionally employed to provide background for reflection photographic prints and, especially those agents possessing the optical properties desired for reflection of incident radiation.

As examples of reflecting pigments adapted for employment in the practice of the present invention, mention may be made of barium sulfate, zinc sulfide, titanium dioxide, barium stearate, silver flake, silicates, alumina, zirconium oxide, zirconium acetyl acetate, sodium zirconium sulfate, kaolin, mica, and the like.

A particularly preferred reflecting agent comprises titanium dioxide due to its highly effective reflection properties. In general, in such preferred embodiment, based upon percent titanium dioxide (weight/volume) a processing composition containing about 1500 to 4000 mgs titanium dioxide dispersed in 100 cc. of water will provide a percent reflectance of about 85 to 90%. In the most preferred embodiments, the percent reflectance particularly desired will be in the order of > about 85%.

Im embodiments wherein the dispersion comprises a preformed layer positioned intermediate the reception layer and next adjacent silver iodochlorobromide, iodochloride and/or iodobromide layer, the pigment layer will be sufficiently transparent to allow transit of exposing radiation through the pigment layer and may comprise titanium dioxide reflecting agent possessing a particle size distribution averaging < about 0.2 $\mu$ in diameter and preferably < about 0.05 $\mu$ in diameter as initially present preceding exposure of the film unit, which preferred materials, upon contact with aqueous alkaline processing composition, preferably aggregate to provide particles possessing a diameter > about 0.2 $\mu$ in diameter and will be coated at a coverage of about 200 to 1000 mgs./ft.$^2$. Specifically, the reflecting agent will be present in a quantity insufficient to prevent exposure of the emulsion layers by actinic radiation incident on the dimensionally stable transparent layer of the film unit but in a concentration sufficient, subsequent to processing, to mask dye developer associated with the silver halide strata from the dye transfer image. In the preferred construction of such embodiment, the pigment such as titanium dioxide will be initially present in a relatively small particle size to provide unexpectedly efficient transit of radiation through the reflecting layer during exposure which upon contact with an alkaline processing composition and aggregation of the pigment particles provides efficient light reflectivity and masking capacity subsequent to such aggregation.

In general, the reflecting agents to be employed are those which remain substantially immobile within their respective compositions during and subsequent to photographic processing and particularly those which comprise insoluble and nondiffusible inorganic pigment dispersions within the layer in which they are disposed.

Where desired, reflecting agent pigment may thus be distributed in whole or in part within a processing composition permeable polymeric matrix such as gelatin and/or any other such polymeric matrixes as are specifically denoted throughout the specification as suitable for employment as a matrix binder and may be distributed in one or more of the film unit layers which may be separated or contiguous, intermediate the image-receiving layer and next adjacent silver halide layer, provided that its distribution and concentration is effective to provide the denoted post processing masking function, and/or in whole or in part the reflecting agent may be ultimately disposed within the processing composition residuum located intermediate the image-receiving layer and next adjacent silver halide strate and associated dye image-forming material.

The optical filter agent selected should be one exhibiting, at a pH above its pKa, maximum spectral absorption of radiation at the wavelengths to which the film unit's photosensitive silver halide layer or layers are sensitive and should be substantially immobile or nondiffusible within the pigment dispersion, during performance of its radiation filtration function, in order to maintain and enhance the optical integrity of the dispersion as a radiation filter unit functioning in accordance with the present invention, and to prevent its diffusion into and localized concentration within the image-receiving layer thereby decreasing the efficiency of the reflecting pigment dispersion as a background against which image formation may be immediately viewed, during the initial stages in the diffusion transfer processing of the film unit, by filter agent absorption of dispersion reflected visible radiation prior to reduction in the environmental pH below the pKa of the agent. Commensurate with the spectral sensitivity range of the associated silver halide layer or layers, the optical filter agent selected may comprise one or more filter dyes possessing absorption complementary to such silver halide in order to provide effective protection against physical fog providing radiation during processing. Recognizing that the filter agent absorption will derogate from image-viewing characteristics by contaminating reflecting pigment background, the selected agents should be those exhibiting major spectral absorption at the pH at which processing is effected and minimal absorption at a pH below that which obtains during transfer image formation. Accordingly, the selected optical filter agent or agents should possess a pKa below that of the processing pH and above that of the environmental pH subsequent to transfer image formation, and will be preferably selected for employment in the minimum concentration necessary to provide an optical transmission density > about 6.0, at wavelengths at which the silver iodochloro-bromide layer is maximally responsive, and an optical reflection density < about 1.0 at such wavelengths.

As specific examples of such pH-sensitive optical filter agents adapted for employment in the practice of the present invention, reference is directed to the agents set forth in aforementioned U.S. Pat. No. 3,647,437, incorporated herein by reference.

In general, preferred agents, both opacifying and filter, are those which remain immobile within their respective compositions during and subsequent to photographic processing and particularly those which comprise insoluble and nondiffusible materials.

As disclosed in the previously cited patents, the liquid processing composition referred to for effecting multicolor diffusion transfer processes comprises at least an aqueous solution of an alkaline material, for example, diethylamine, sodium hydroxide or sodium carbonate and the like, and preferably possessing a pH in excess of 12, and most preferably includes a viscosity-increasng compound constituting a film-forming material of the type which, when the composition is spread and dried, forms a relatively firm and relatively stable film. The preferred film-forming materials disclosed comprise high molecular weight polymers such as polymeric, water-soluble ethers which are inert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time are also disclosed to be capable of utilization. As stated, the film-forming material is preferably contained in the processing composition in such suitable quantities as to impart to the composition a viscosity in excess of 100 cps. at a temperature of approximately 24° C. and preferably in the order of 100,000 cps. to 200,000 cps. at that temperature.

In the performance of a diffusion transfer multi-color process employing film unit 10, the unit is exposed to radiation, actinic to photosensitive laminate 13, incident on the laminate's exposure surface, as illustrated in FIG. 3.

Subsequent to exposure, as illustrated by FIGS. 2 and 4, film unit 10 is processed by being passed through opposed suitably gapped rolls 35 in order to apply compressive pressure to frangible container 11 and to effect rupture of longitudinal seal 30 and distribution of alkaline processing composition 12, possessing inorganic light-reflecting pigment and optical filter agent at a pH above the pKa of the filter agent and a pH at which the cyan, magenta and yellow dye developers are soluble and diffusible as a function of the point-to-point degree of exposure of red-sensitive silver halide layers 15 and 16, green-sensitive silver halide layers 18 and 19 and blue-sensitive silver halide layers 21 and 22, respectively, intermediate image-receiving layer 24 and auxiliary layer 23.

Alkaline processing composition 12 permeates emulsion layers 15, 16, 18, 19, 21 and 22 to initiate development of the latent images contained in the respective emulsions. The cyan, magenta and yellow dye developers, of layers 15, 18 and 21, are immobilized, as a function of the development of the associated silver halide emulsions, preferably substantially as a result of their conversion from the reduced form to their relatively insoluble and nondiffusible oxidized form, thereby providing imagewise distributions of mobile, soluble and diffusible cyan, magenta and yellow dye developer, as a function of the point-to-point degree of their associated emulsion's exposure. At least part of the imagewise distributions of mobile cyan, magenta and yellow dye developer transfers, by diffusion, to dyeable polymeric layer 24 to provide a multicolor dye transfer image to that layer which is viewable against the background provided by the reflecting pigment present in processing composition residuum 12 masking cyan, magenta and yellow dye developer remaining associated with blue-sensitive emulsion layers 21 and 22, green-sensitive emulsion layers 18 and 19 and red-sensitive emulsion layers 15 and 16. Subsequent to substantial transfer image formation, a sufficient portion of the ions comprising aqueous alkaline processing composition 12 transfer, by diffusion, through permeable polymeric reception layer 24, permeable spacer layer 25 to polymeric neutralizing layer 26 whereby the environmental pH of the system decreases as a function of neutralization to a pH at which the cyan, magenta and yellow dye developers, in the reduced form, are substantially nondiffusible to thereby provide a stable multicolor dye transfer image and discharge of the pH-sensitive optical filter agent by reduction of the pH substantially below the pKa of such agent to thereby provide maximum reflectivity in terms of the pigment concentration present.

The alkaline solution component of the processing composition, positioned intermediate the photosensitive element and the image-receiving layer, thus permeates the emulsions to initiate development of the latent images contained therein. The respective associated dye developers are mobilized imagewise in terms of unexposed areas as a consequence of the development of the latent images. In unexposed and partially exposed areas of the emulsions, the associated dye developer is diffusible and thus provides an imagewise distribution of dye developer dissolved in the liquid processing composition, as a function of the point-to-point degree of exposure of the respective silver halide emulsions. At least part of this imagewise distribution of dye developer is transferred, by imbibition, to a superposed image-receiving layer or element. The image-receiving element receives a depth-wise diffusion, from the developed emulsion, of dye developer without appreciably disturbing the imagewise distribution thereof to provide the reversed or positive color image of the developed image.

Subsequent to distribution of processing composition 12, container 11 may be manually dissociated from the remainder of the film unit, as described above, to provide the product illustrated in FIG. 6.

The present invention will be further illustrated and detailed in conjunction with the following illustrative constructions which set out representative embodiments of the novel photographic film units of this invention, which, however, are not limited to the details therein set forth and are intended to be illustrative only.

Film units similar to that shown in the drawings may be prepared, for example, by coating, on a 5 mil. opaque polyester film base, the following layers:

1. a layer of the cyan dye developer

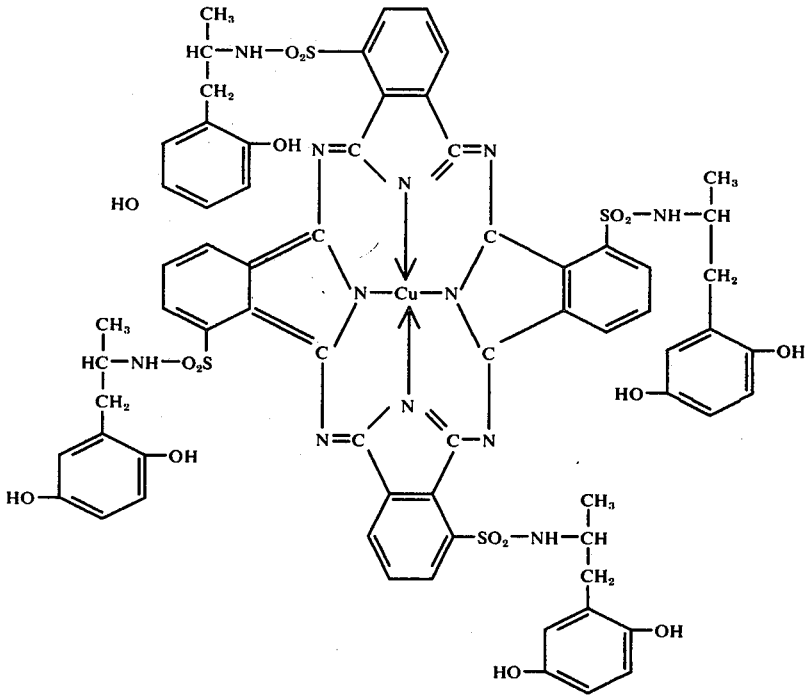

and red-sensitive silver iodobromide possessing a mean particle size of about 0.85 $\mu$ dispersed in gelatin and coated at a coverage of about 50 mgs./ft.$^2$ of dye, about 60 mgs./ft. $^2$ of silver and about 51 mgs./ft.$^2$ of gelatin, and 4′ methylphenyl hydroquinone coated at a coverage of 10 mgs./ft.$^2$;

2. a red-sensitive gelatino-silver iodobromide emulsion possessing a mean silver halide particle size of about 1.4 $\mu$ coated at a coverage of about 60 mgs./ft.$^2$ of silver and about 58 mgs./ft.$^2$ of gelatin;

3. a layer of butyl acrylate/diacetone acrylamide/-styrene/methacrylic acid (60/30/4/6) and about 3% polyacrylamide coated at a coverage of about 336 mgs./ft.$^2$;

4. a layer of the magenta dye developer

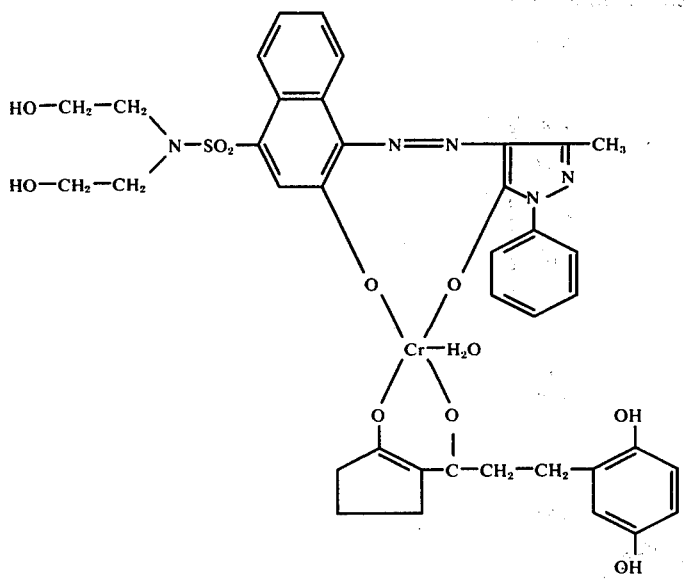

and green-sensitive silver iodobromide possessing a mean particle size of about 0.85 $\mu$ dispersed in gelatin and coated at a coverage of about 80 mgs./ft.$^2$ of dye, about 60 mgs./ft.$^2$ of silver, and about 85 mgs./ft.$^2$ of gelatin.

5. a green-sensitive gelatino-silver iodobromide emulsion possessing a mean silver halide particle size of about 1.4 $\mu$ coated at a coverage of about 45 mgs./ft.$^2$ of silver and 65 mgs./ft.$^2$ of gelatin;

6. a layer comprising butyl acrylate/diacetone acrylamide/styrene/methacrylic acid (60/30/4/6) and about 3% polyacrylamide coated at a coverage of about 104 mgs./ft.$^2$ and succindialdehyde coated at a coverage of about 10 mgs./ft.$^2$;

7. a layer of the yellow dye developer

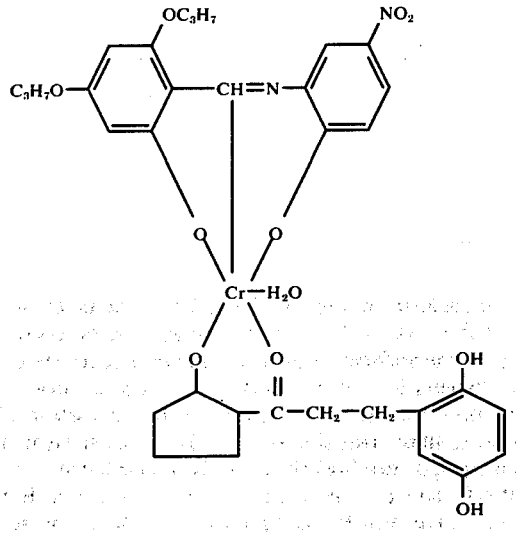

dispersed in gelatin and coated at a coverage of about 75 mgs./ft.$^2$ of dye, about 30 mgs./ft.$^2$ of gelatin, and 2 phenylbenzimidazole coated at a coverage of 20 mgs./ft.$^2$;

8. a blue-sensitive gelatino-silver iodobromide emulsion containing the auxiliary developer 4'-methylphenyl hydroquinone coated at a coverage of about 96 mgs./ft.$^2$ of silver, about 33 mgs./ft.$^2$ of auxiliary developer, and about 42 mgs./ft.$^2$ of gelatin; and 9. a layer of gelatin coated at a coverage of about 30 mgs./ft.$^2$ of gelatin.

A transparent 5 mil polyethylene terephthalate film base may be coated, in succession, with the following illustrative layers:

1. the partial butyl ester of polyethylene/maleic anhydride copolymer prepared by refluxing, for 14 hours, 300 gms. of high viscosity poly-(ethylene/maleic anhydride), 140 gms. of n-butyl alcohol and 1 cc. of 85% phosphoric acid to provide a polymeric acid layer at a coverage of about 2500 mgs./ft.$^2$;

2. a timing layer containing about a 40:1 ratio of a 60/30/4/6 copolymer of butylacrylate, diacetone acrylamide, styrene and methacrylic acid and polyacrylamide at a coverage of about 500 mgs./ft.$^2$; and 3. a 2:1 mixture, by weight, of polyvinyl alcohol and poly-4-vinylpyridine, at a coverage of about 400 mgs./ft.$^2$ to provide a polymeric image-receiving layer.

The two components thus prepared may then be taped together in laminate form, at their respective edges, by means of a pressure-sensitive binding tape extending around, in contact with, and over the edges of the resultant laminate.

A rupturable container comprising an outer layer of lead foil and an inner liner or layer of polyvinyl chloride retaining an aqueous alkaline processing composition may then be fixedly mounted on the leading edge of each of the laminates, by pressure-sensitive tapes interconnecting the respective containers and laminates, such that, upon application of compressive pressure to a container, its contents may be distributed, upon rupture of the container's marginal seal, between the polymeric image-receiving layer and next adjacent gelatin layer. Exemplary of such processing compositions is the following fomulation:

| | |
|---|---|
| Potassium hydroxide (85%) | 4.6 g. |
| N-benzyl-$\alpha$-picolinium bromide (50% solution in water) | 1.24 g. |

-continued

| | |
|---|---|
| N-phenethyl-α-picolinium bromide | 0.72 g. |
| Sodium carboxymethyl cellulose (Hercules Type 7H4F providing a viscosity of 3,000 cps. at 1% in water at 25° C.) | 1.06 g. |
| Titanium dioxide | 41.8 g. |
| 6-methyl uracil | 0.29 g. |
| bis-(β-aminoethyl)-sulfide | 0.02 g. |
| Lithium nitrate | 0.1 g. |
| Benzotriazole | 0.55 g. |
| 6-methyl-5-bromo-4-azabenzimidazole | 0.02 g. |
| Colloidal silica aqueous dispersion (30% $SiO_2$) | 1.82 g. |
| N-2-hydroxyethyl-N, N', N'-triscarboxymethyl-ethylene diamine | 0.82 g. |
| Lithium hydroxide | 0.19 g. |
| 6-benzylamino-purine | 0.39 g. |
| Polyethylene glycol (molecular weight 6,000) | 0.53 g. |
| (I) 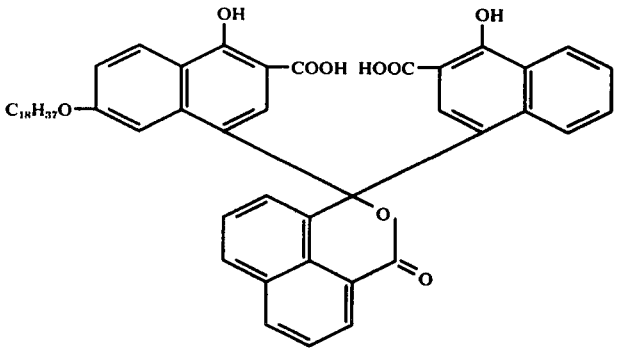 | 2.69 g. |
| (II) 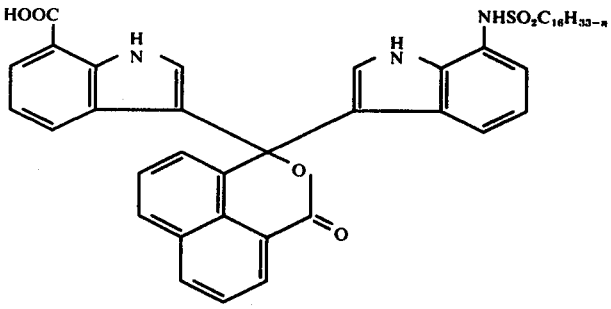 | 0.6 g. |
| Water to make 100 g. | |

The photosensitive composite film units may be exposed through radiation incident on the transparent polyester film base and processed by passage of the exposed film units through appropriate pressure-applying members, such as suitably gapped, opposed rolls, to effect rupture of the container and distribution of its contents. Subsequent to processing, the multicolor dye transfer image formation may be viewed through the transparent polyester layer against the titanium dioxide background provided by distribution of the pigment containing processing composition between Layer 9 and the polymeric image-receiving layer.

The gelatino silver iodobromide emulsions employed may be prepared as previously detailed and appropriately sensitized spectrally by addition of an effective concentration of one or more optical sensitizing dyes dispersed in an appropriate carrier solvent.

By the addition of the "indicator" components as identified at (I) and (II) above to the processing composition, image formation may be immediately viewed upon distribution of the processing composition by reason of the protection against incident radiation afforded the photosensitive silver halide emulsion layers by the composition's optical transmission density of > about 6.0 density units and against the titanium dioxide's effective reflective background afforded by reason of the composition possessing an optical reflection density of < about 1.0 density units.

Figure 8:
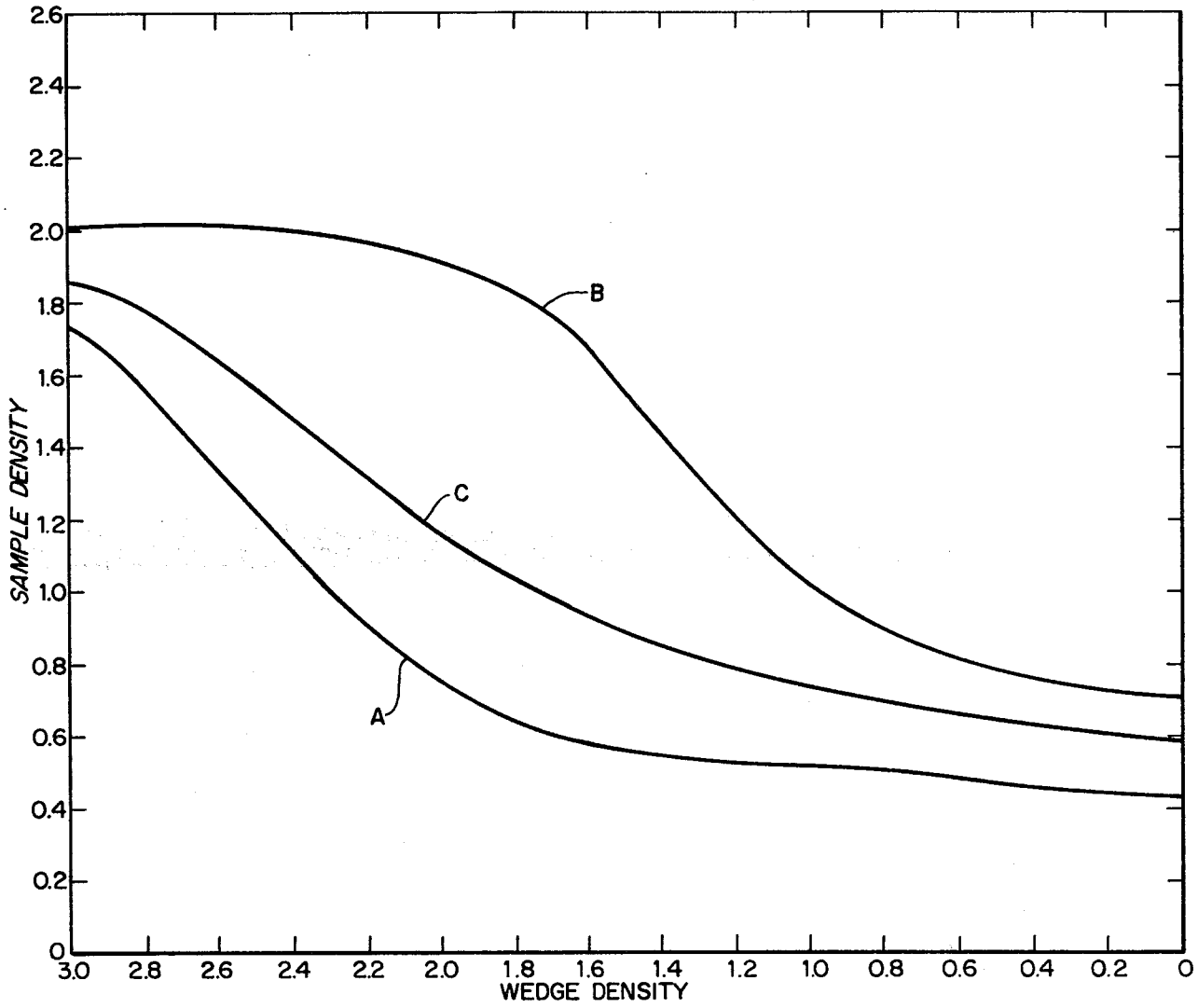
FIG. 8 is a graphic representation of characteristic curves of monochrome dye transfer images for differently structured photosensitive units.

The speed separation feature of the composite photosensitive units of film units structured according to the invention is illustrated by the family of characteristic curves shown in FIG. 8. To derive the curves represented therein, monochromatic film unit samples were prepared and exposed to red illumination utilizing a continuous gradient neutral density wedge technique, following which they were processed and analyzed. One sample, the analysis of which derived the characteristic curve labeled A in the figure was prepared by coating on a 5 mil opaque polyester film base, a layer of the above-identified cyan dye developer at a coverage of about 70 mgs./ft.$^2$. Over this layer was coated red-sensitive silver iodobromide dispersed in gelatin at a coverage of about 70 mgs./ft.$^2$ silver and about 35 mgs./ft.$^2$ gelatin. The composite unit was exposed as noted above and, subsequently, processed utilizing a processing composition as above described.

Another sample, the analysis of which derived the characteristic curve labeled B in the figure, was prepared by coating on a 5 mil opaque polyester film base a layer of the above-identified cyan dye developer at a coverage of about 70 mgs./ft.$^2$ in combination with red-sensitive silver iodobromide dispersed in gelatin at a coverage of about 70 mgs./ft.$^2$ silver. The composite unit was exposed as above and processed utilizing a processing composition as above described.

A third sample, the analysis of which derived the characteristic curve labeled C in the figure was prepared by coating on a 5 mil opaque polyester film base a combination layer of the above-identified cyan dye developer at a coverage of about 70 mgs./ft.$^2$ and red-sensitive silver iodobromide dispersed in gelatin at a coverage of about 35 mgs./ft.$^2$ silver. Over the above layer, red-sensitive silver iodobromide dispersed in gelatin was coated at a coverage of about 35 mgs./ft.$^2$ silver. The composite unit was exposed using the noted continuous gradient neutral density wedge technique in conjunction with red light and was processed using a processing composition as above described.

Curve A of the family of curves in the figure provides some indication of the participation of the dye-free silver halide layer positioned above the image-forming dye-silver halide layer of a composite photosensitive unit. The speed represented by Curve A, which may be a valuation measured at the 0.8 sample density intercept of the curve, has a relative value of about 2.1 units. Curve B of the figure provides an indication of the participation of the lower layer of a composite photosensitive unit in which the dye image-forming material is combined with silver halide. Note that the 0.8 sample density intercept of this curve provides a relative speed valuation of 0.54 units. Accordingly, the difference in speeds represented by the film unit configurations of Curves A and B is in excess of 5 stops, 0.3 units along the wedge density scale representing 1 stop. Curve C is representative of a composite film unit according to the invention, a dye-free layer being positioned over a layer combining silver halide and dye. Note that the gamma or gradient exhibited, for instance, between the 0.75 and 1.25 sample density value intercepts of the curve is lower than the corresponding gammas exhibited by Curves A and B. The noted gamma values of respective Curves A and B are separated by a differential of about 0.25.

In preparing the samples deriving Curves A–C in FIG. 8, the same silver halide emulsion formulation was utilized throughout to provide for an appropriate comparison of the varying structures. Where the formulations are utilized within a tripack structure, the DMIN characteristics of the curves, representing minimum plotted density value for a given color, will be lower by virtue of the influence of photosensitive units intermediate the exposure plane of the film unit and the photosensitive unit incorporating red-sensitive silver halide and cyan dye developer. Accordingly, lower sample density intercept points are utilized to provide speed and gamma data in the discussion to follow concerning FIGS. 9–12.

FIGS. 9–12 reveal, by comparative analysis thereof, the advantageous features of tripack type film unit structures fabricated in accordance with the present invention. The figures particularly illustrate an advantageous utilization of silver halide dispersions having larger and smaller mean grain sizes respectively in the dye free layer and dye containing layer of composite photosensitive units within the film structures. Curves in the noted figures representing the red, green and blue record of the samples are labeled, respectively, by the letters R, G and B.

Figure 9:
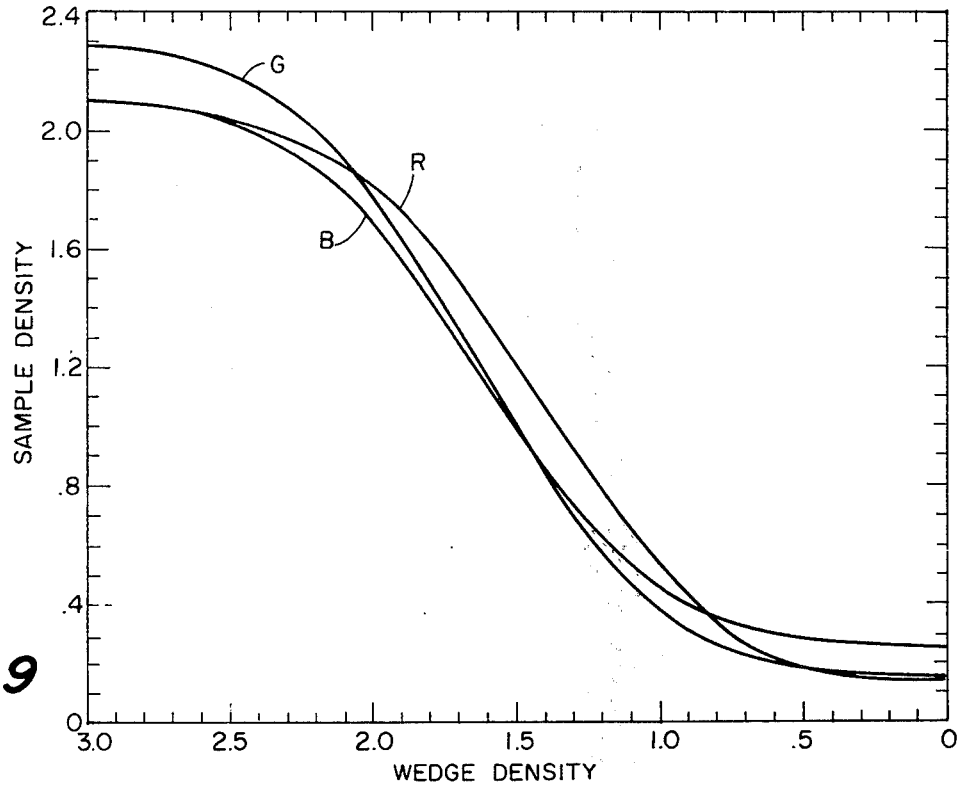
FIGS. 9–12 are graphical representations of the characteristic curves of multicolor dye transfer images produced for integral densitometric evaluation of film units of selectively varied structure.

A film unit sample, the analysis of which is illustrated by the diffusion transfer characteristic curves of FIG. 9, was fabricated generally as denoted above so as to provide an addition of red-sensitive silver iodobromide having a mean particle size of about 0.85 $\mu$ to the cyan dye developer layer, while the dye free red-sensitive silver iodobromide layer was provided having a mean grain size of about 1.4 microns. The next adjacent composite photosensitive unit was similarly prepared, i.e., green-sensitive silver iodobromide possessing a mean silver halide particle size of about 0.85 $\mu$ was combined with magenta dye developer; while the adjacent dye-free layer was formed of green-sensitive silver iodobromide possessing a mean silver halide particle size of about 1.4 $\mu$. The sample was exposed utilizing a continuous gradient neutral density wedge technique in a manner providing for spectrometric analysis and, subsequently, processed.

Data tabulations derived from the curves of FIG. 9, as set forth in Table I, reveal desirable gamma values. These gamma values represent the gradient defined between sample density value intercepts of 1.05 and 0.55. The speed valuations are shown in the table under the label 75INT and represent a speed valuation measured at the 0.75 sample density intercept for each of the respective curves. Table I also reveals dynamic range, DYRNG, toe extent, TOEXT and normalized slope, NSLPE, for the curves. Dynamic range is a relative measurement of the range of exposure from which the useful dye transfer image may be derived, its value being derived from a formula relating the extent of a transfer curve between two points of predetermined useful slope. These points are related by formula to derive the ratio of minimum to maximum exposure in a subject which can usefully be recorded by the film unit. The toe extent data represents the extent of the wege density portion of the curve between those points of the curve exhibiting a slope of 1.0 and a slope of 0.20. Accordingly, larger values of toe extent and dynamic range represent a desirable quality for a diffusion transfer film unit, larger dynamic range values representing a capability of a high maximum density and low minimum density recordation and larger values for the toe extent representing a capability for reproducing luminence differences existing in an object to be photographically reproduced particularly where lighter tones are present. Note in the data of Table I, the values for toe extent and dynamic range are relatively broad. The normalized slope values represent gamma values adjusted to accommodate for or neutralize the variational effect of noncorresponding maximum and minimum density values and consequently, these values provide a more suitable basis for gamma comparison.

TABLE I

| | Red | Green | Blue |
|---|---|---|---|
| Gamma | 1.262 | 1.342 | 1.211 |
| TOEXT | 0.468 | 0.567 | 0.600 |
| 75INT | 1.151 | 1.321 | 1.301 |
| DYRNG | 46.810 | 54.300 | 39.520 |
| NSLPE | 0.641 | 0.636 | 0.651 |

Figure 10:
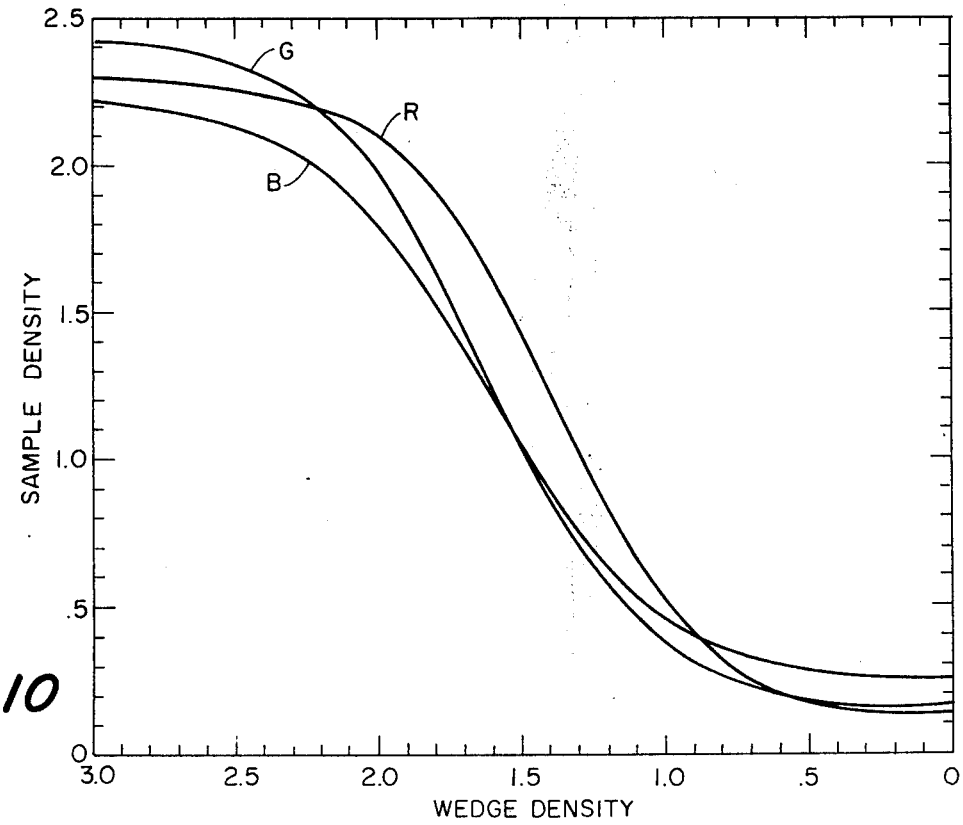

Looking, by comparison, to the performance of a control film unit as represented by the curves of FIG. 10, a film unit structure was fabricated generally as denoted above with the exceptions that the silver halide dispersion, shown earlier as having a mean particle size of 0.85 $\mu$, was removed from the cyan dye developer layer and blended in the associated next upper red-sensitive silver halide layer and the total coated quantity of silver halide in the blended layer was decreased by 25%. With this arrangement, certain of the above-described desirable attributes are diminished. Referring to Table II, data derived from the curves of FIG. 10 is provided. Note that an enlargement of gamma value in the red record as well as a dimunition in dynamic range and toe extent as compared to the data of Table I is present. This lowering of derived performance is present even though the coating quantities were reduced as above noted. The green record additionally shows a dimunition in dynamic range when compared with the corresponding green record data in Table I.

TABLE II

| | Red | Green | Blue |
|---|---|---|---|
| Gamma | 1.665 | 1.464 | 1.308 |
| TOEXT | 0.441 | 0.511 | 0.615 |
| 75INT | 1.125 | 1.301 | 1.279 |
| DYRNG | 33.180 | 48.270 | 39.120 |
| NSLPE | 0.774 | 0.648 | 0.664 |

Figure 11:
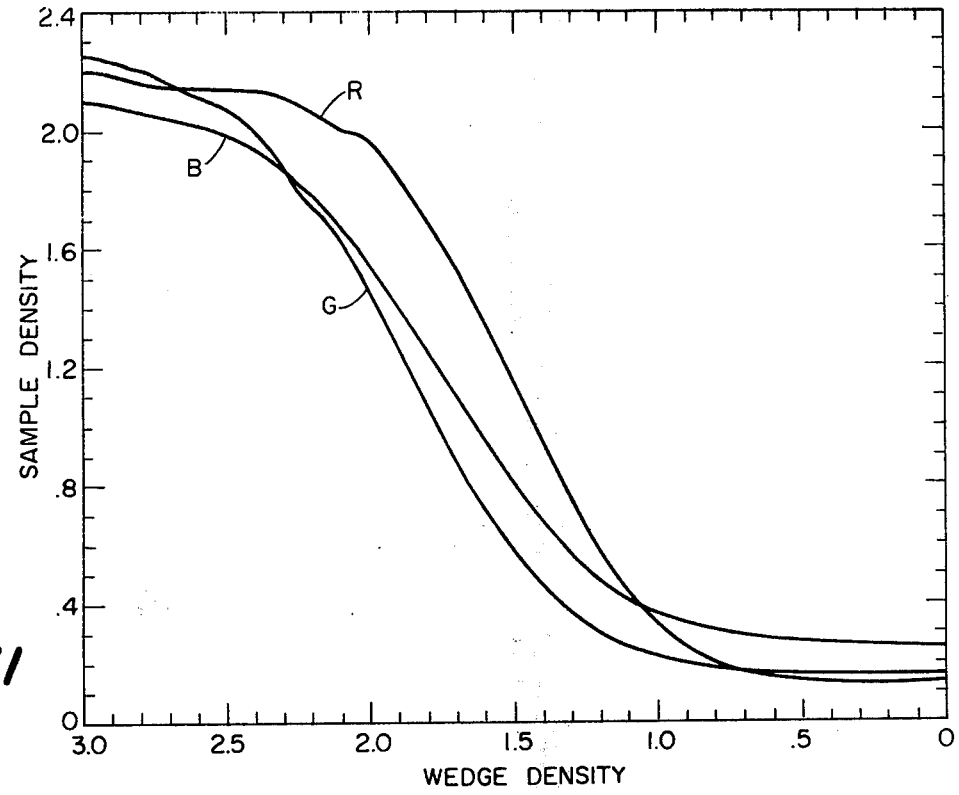

Looking to FIG. 11, the performance of another film unit is represented. This film unit structure was fabricated generally as denoted above with the exceptions that those silver halide dispersions having a mean particle size of 0.85 $\mu$ were combined or blended with the larger grain (1.4 $\mu$) silver halide in the upper layer of each of the photosensitive units and the total coated quantity for the red-sensitive silver halide dispersion was reduced by 25%, as compared with the film unit described in conjunction with FIG. 9. Accordingly, all dye image-forming layers were substantially free of silver in this sample. Analytical data obtained from the sample film unit is presented in Table III. Looking to that table and comparing it with the data of Table II, it may be noted that the values for normalized slope (NSLPE) in all records are higher while toe extent (TOEXT) and dynamic range (DYRNG) are lower in value. As before, these less desirable values obtain even though a dimunition in red-sensitive silver halide is provided.

TABLE III

| | Red | Green | Blue |
|---|---|---|---|
| Gamma | 1.843 | 1.483 | 1.282 |
| TOEXT | 0.341 | 0.450 | 0.491 |
| 75INT | 1.283 | 1.598 | 1.436 |
| DYRNG | 29.420 | 37.340 | 35.100 |
| NSLPE | 0.890 | 0.710 | 0.697 |

Figure 12:
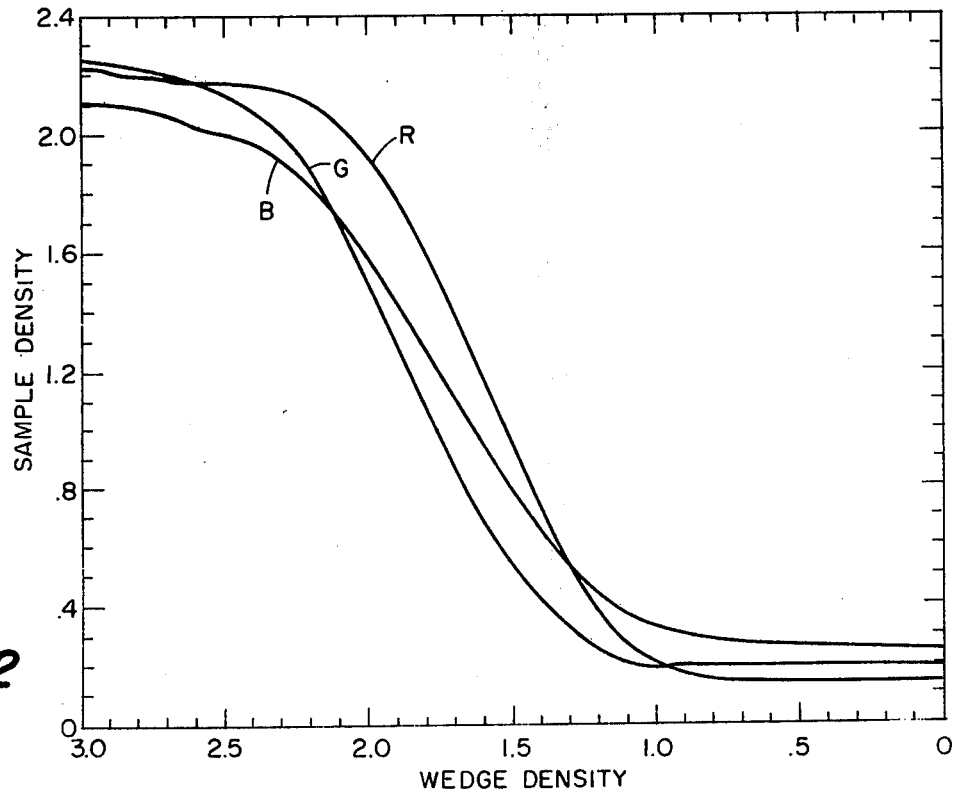

Turning now to FIG. 12, characteristic curves are revealed which were derived from a control diffusion transfer film unit fabricated generally as denoted above with the exception that those silver halide dispersions having a mean particle size of 0.85 $\mu$ now are combined or blended with the larger grain silver halide in the upper layer of each of the photosensitive units. All dye image-forming layers are substantially free of silver in this sample. Analytical data obtained from the sample film unit is presented in Table IV. Looking to that table, it may be noted that the gamma values for the red and blue record have increased in value over the corresponding data in Tables I–III. It additionally may be observed that toe extent as well as dynamic range values for the curves of FIG. 12 are relatively low. The samples of FIGS. 10–12 tend to show that desired low gammas, higher toe extent and expanded dynamic range characteristics are not readily achieved through a combination of fine and coarse silver halide particulate distributions within a film structure.

TABLE IV

| | Red | Green | Blue |
|---|---|---|---|
| Gamma | 2.009 | 1.718 | 1.365 |
| TOEXT | 0.283 | 0.376 | 0.437 |
| 75INT | 1.391 | 1.609 | 1.456 |
| DYRNG | 21.080 | 25.230 | 25.540 |
| NSLPE | 0.966 | 0.822 | 0.734 |

Looking in more detail to the development aspects of film units fabricated in accordance with the invention, the pH and solvent concentration of the alkaline processing solution initially employed will possess a pH above the pKa of the optical filter agents where the latter are employed, that is, the pH at which about 50% of the agents are present as the lesser absorbing species and about 50% are present as the greater absorbing species, preferably a pKa of > about 11 and most preferably > about 12 and a pH at which the dye developers employed are soluble and diffusible. Although it has been found that the specific pH to be employed may be readily determined empirically for any dye developer and optical filter agent, or group of dye developers and filter agents, most particularly desirable dye developers are soluble at pH's above 9 and relatively insoluble at pH's below 9, in reduced form, and relatively insoluble at substantially any alkaline pH, in oxidized form, and the system can be readily balanced accordingly for such dye developers. In addition, although as previously noted, the processing composition, in the preferred embodiment, will include the stated film-forming viscosity-increasing agent, or agents, to facilitate spreading of the composition and to provide maintenance of the spread composition as a structurally stable layer of the laminate, subsequent to distribution, it is not necessary that such agent be employed as a component of the composition.

Neutralizing means, for example, a polymeric acid layer of the type discussed above may be incorporated, as stated, in the film unit of the present invention, to provide reduction of the alkalinity of the processing solution from a pH above the pKa of the optical filter agent selected at which the dyes are soluble to a pH below the pKa of the agent at which the dyes are substantially nondiffusible, in order to advantageously further stabilize and optimize reflectivity of the dye transfer image. In such instance, the neutralizing layer may comprise particulate acid reacting reagent disposed within the film unit or a polymeric acid layer, for example, a polymeric acid layer approximating 0.3 to 1.5 mils. in thickness, positioned intermediate the transparent support and image-receiving layer, and/or the opaque support and next adjacent emulsion/dye unit layer, and the film unit may also contain a polymeric spacer or barrier layer, for example, approximating 0.1 to 0.7 mil. in thickness, next adjacent the polymeric acid layer, opposite the respective support layer, as previously described.

Specifically, the film units may employ the presence of a polymeric acid layer such as, for example, of the type set forth in U.S. Pat. No. 3,362,819 which, most preferably, includes the presence of an inert timing or spacer layer intermediate the polymeric acid layer carried on a support and the image-receiving layer.

As set forth in the last-mentioned patent, the polymeric acid layer may comprise polymers which contain acid groups, such as carboxylic acid and sulfonic acid groups, which are capable of forming salts with alkali metals, such as sodium, potassium etc., or with organic bases, particularly quaternary ammonium bases, such as tetramethyl ammonium hydroxide, or potentially acid-yielding groups, such as anhydrides or lactones, or other groups which are capable of reacting with bases to capture and retain them. The acid-reacting group is, of course, retained in the polymer layer. In the preferred embodiments disclosed, the polymer contains free carboxyl groups and the transfer processing composition employed contains a large concentration of sodium and/or potassium ions. The acid polymers stated to be most useful are characterized by containing free carboxyl groups, being insoluble in water in the free acid form, and by forming water-soluble sodium and/or potassium salts. One may also employ polymers containing carboxylic acid anhydride groups, at least some of which preferably have been converted to free carboxyl groups prior to imbibition. While the most readily available polymeric acids are derivatives of cellulose or of vinyl polymers, polymeric acids from other classes of polymers may be used. As examples of specific polymeric acids set forth in the application, mention may be made of dibasic acid half-ester derivatives of cellulose which derivatives contain free carboxyl groups, e.g., cellulose acetate hydrogen phthalate, cellulose acetate hydrogen glutarate, cellulose acetate hydrogen succinate, ethyl cellulose hydrogen succinate, ethyl cellulose acetate hydrogen succinate, cellulose acetate hydrogen succinate hydrogen phthalate; ether and ester derivatives or cellulose modified with sulfoanhydrides, e.g., with ortho-sulfobenzoic anhydride; polystyrene sulfonic acid; carboxymethyl cellulose; polyvinyl hydrogen phthalate; polyvinyl acetate hydrogen phthalate; polyacrylic acid; acetals of polyvinyl alcohol with carboxy or sulfo substituted aldehydes, e.g., o-, m-, or p-benzaldehyde sulfonic acid or carboxylic acid; partial esters of ethylene/maleic anhydride copolymers; partial esters of methyl-vinyl ether/maleic anhydride copolymers; etc.

As previously noted, the pH of the processing composition preferably is of the order of at least 12 to 14 and the pKa of the selected optical filter agents will accordingly preferably be in the order of 13 or greater. The polymer layer is disclosed to contain at least sufficient acid groups to effect a reduction in the pH of the image layer from a pH of about 12 to 14 to a pH of at least 11 or lower at the end of the imbibition period, and preferably to a pH of about 5 to 8 within a short time after imbibition, thus requiring, of course, that the action of the polymeric acid be accurately so controlled as not to interfere with either development of the negative or image transfer of unoxidized dye developers. For this reason, the pH of the image layer must be kept at a functional transfer level, for example, 12 to 14 until the dye image has been formed after which the pH is reduced very rapidly to a pH below that at which dye transfer may be accomplished, for example, at least about 11 and preferably about pH 9 to 10. Unoxidized dye developers containing hydroquinonyl developing radicals diffuse from the negative to the positive as the sodium or other alkali salt. The diffusion rate of such dye image-forming components thus is at least partly a function of the alkali concentration, and it is necessary that the pH of the image layer remain on the order of, for example, 12 to 14 until transfer of the necessary quantity of dye has been accomplished. The subsequent pH reduction, in addition to its desirable effect upon image light stability, serves a highly valuable photographic function by substantially terminating further dye transfer.

In order to prevent premature pH reduction during transfer processing, as evidenced, for example, by an undesired reduction in positive image density, the acid groups are disclosed to be so distributed in the polymer layer that the rate of their availability to the alkali is controllable, e.g., as a function of the rate of swelling of the polymer layer which rate in turn has a direct relationship to the diffusion rate of the alkali ions. The desired availability of the acid groups in the polymer layer may be effected by mixing acid polymer with a polymer free of acid groups, or lower in concentration of acid groups, and compatible therewith, as a modulated system, or by using only an acid polymer but selecting one having a predetermined acid group availability rate.

The layer containing the polymeric acid may contain a water-insoluble polymer, preferably a cellulose ester, which acts to control or modulate the rate at which the alkali salt of the polymer acid is formed. As examples of cellulose esters contemplated for use, mention is made of cellulose acetate, cellulose acetate butyrate, etc. The particular polymers and combinations of polymers employed in any given embodiment are, of course, selected so as to have adequate wet and dry strength and when necessary or desirable suitable subcoats are employed to help the various polymeric layers adhere to each other during storage and use.

The inert spacer layer of the last-mentioned patent, for example, an inert spacer layer comprising polyvinyl alcohol or gelatin, acts to "time" control the pH reduction by the polymeric acid layer. This timing is disclosed to be a function of the rate at which the alkali diffuses through the inert spacer layer. It is there stated to have been found that the pH does not drop until the alkali has passed through the spacer layer, i.e., the pH is not reduced to any significant extent by the mere diffusion into the interlayer, but the pH drops quite rapidly once the alkali diffuses through the spacer layer.

As disclosed in aforementioned U.S. Pat. No. 3,362,819, the presence of an inert spacer layer was found to be effective in evening out the various reaction rates over a wide range of temperatures, for example, by preventing premature pH reduction when imbibition is effected at temperatures above room temperature, for example, at 95° to 100° F. By providing an inert spacer layer, that application discloses that the rate at which alkali is available for capture in the polymeric acid layer becomes a function of the alkali diffusion rates.

However, as disclosed in U.S. Pat. No. 3,455,686 preferably the aforementioned rate at which the cations of the alkaline processing composition, i.e., alkali ions, are available for capture in the polymeric acid layer should be decreased with increasing transfer processing temperatures in order to provide diffusion transfer color processes relatively independent of positive transfer image variations over an extended range of ambient temperatures.

Specifically, it is there stated to have been found that the diffusion rate of alkali through a permeable inert polymeric spacer layer increases with increased processing temperature to the extent, for example, that at relatively high transfer processing temperatures, that is, transfer processing temperatures above approximately 80° F., a premature decrease in the pH of the transfer processing composition occurs due, at least in part, to the rapid diffusion of alkali from the dye transfer environment and its subsequent neutralization upon contact with the polymeric acid layer. This was stated to be especially true of alkali traversing an inert spacer layer possessing permeability to alkali optimized to be effective with the temperature range of optimum transfer processing. Conversely, at temperatures below the optimum transfer processing range, for example, temperatures below approximately 40° F., the last-mentioned inert spacer layer was disclosed to provide an effective diffusion barrier timewise preventing effective traverse of the inert spacer layer by alkali having temperature depressed diffusion rates and to result in maintenance of the transfer processing environment's high pH for such an extended time interval as to facilitate formation of transfer image stain and its resultant degradation of the positive transfer images' color definition.

It is further stated in the last-mentioned U.S. Pat. No. 3,455,686 to have been found, however, that if the inert spacer layer of the print-receiving element is replaced by a spacer layer which comprises a permeable polymeric layer exhibiting permeability inversely dependent on temperature, that is, a polymeric film-forming material which exhibits decreasing permeability to solubilized alkali derived cations such as alkali metal and quaternary ammonium ions under conditions of increasing temperature, that the positive transfer image defects resultant from the aforementioned overextended pH maintenance and/or premature pH reduction are obviated.

As examples of polymers which were disclosed to exhibit inverse temperature-dependent permeability to alkali, mention may be made of: hydroxypropyl polyvinyl alcohol, polyvinyl methyl ether, polyethylene oxide, polyvinyl oxazolidone, hydroxypropyl methyl cellulose, isopropyl cellulose, partial acetals of polyvinyl alcohol such as partial polyvinyl butyral, partial polyvinyl formal, partial polyvinyl acetal, partial polyvinyl propional, and the like.

The last-mentioned specified acetals of polyvinyl were stated to generally comprise saturated aliphatic hydrocarbon chains of a molecular weight of at least 1000, preferably of about 1000 to 50,000, possessing a degree of acetalation within about 10 to 30%, 10 to 30%, 20 to 80%, and 10 to 40%, of the polyvinyl alcohol's theoretical polymeric hydroxy groups, respectively, and including mixed acetals where desired.

Where desired, a mixture of the polymers may be employed, for example, a mixture of hydroxypropyl methyl cellulose and partial polyvinyl butyral.

Employment of the detailed and preferred film units of the present invention, according to the herein described color diffusion transfer process, specifically provides for the production of a highly stable transfer image accomplished, at least in part, by effectively obviating the previously discussed disadvantages of the prior art products and processes, by in process adjustment of the environmental processing composition solvent and pH concentration from a solvent and pH concentration at which dye diffusion or transfer is operative to a solvent and pH concentration at which dye transfer is inoperative subsequent to substantial transfer image formation. The stable color transfer image is obtained irrespective of the fact that the film unit is maintained as an integral laminate unit during exposure, processing, viewing, and storage of the unit. Accordingly, by means of the present invention, multicolor transfer images may be provided over an extended processing temperature range which exhibit desired maximum and minimum dye transfer image densities; yellow, magenta and cyan dye saturation; red, green and blue hues; and color separation. These unexpected advantages are in addition to the manufacturing advantages obtained by reason of the present invention's integral color transfer film unit construction and which will be readily apparent from examination of the unit's parameters, that is, for example, advantages in more efficient utilization of fabricating materials and components, enhanced simplicity of film manufacture and camera design and construction, and more simplified and effectively controlled customer utilization of the unit.

The dimensionally stable support layers referred to may comprise any of the various types of conventional opaque and transparent rigid or flexible materials possessing the requisite liquid impermeability and, preferably, the vapor transmissivity denoted above, and may comprise polymeric films of both synthetic types and those derived from naturally occurring products. Particularly suitable materials include aqueous alkaline solution impermeable, water vapor permeable flexible polymeric materials such as vapor permeable polymeric films derived from ethylene glycol terephthalic acid, vinyl chloride polymers; polyvinyl acetate; polyamides; polymethacrylic acid methyl and ethyl esters; cellulose derivatives such as cellulose, acetate, triacetate, nitrate, propionate, butyrate, acetate-propionate, or acetate-butyrate; alkaline solution impermeable, water vapor permeable papers; crosslinked polyvinyl alcohol; regenerated cellulose; and the like.

As examples of materials, for use as the image-receiving layer, mention may be made of solution dyeable polymers such as nylon as, for example, N-methoxymethyl polyhexamethylene adipamide; partially hydrolyzed polyvinyl acetate; polyvinyl alcohol with or without plasticizers; cellulose acetate with filler as, for example, one-half cellulose acetate and one-half oleic acid; gelatin; and other materials of a similar nature. Preferred materials comprise polyvinyl alcohol or gelatin containing a dye mordant such as poly-4-vinylpyridine, as disclosed in U.S. Pat. No. 3,148,061, issued Sept. 8, 1964.

It will be noted that the liquid processing composition employed may contain an auxiliary or accelerating developing agent, such as p-methylaminophenol, 2,4-diaminophenol, p-benzylaminophenyl, hydroquinone, toluhydroquinone, phenylhydroquinone, 4'-methylphenylhydroquinone, etc. It is also contemplated to employ a plurality of auxiliary or accelerating developing agents, such as a 3-pyrazolidone developing agent and a benzenoid developing agent, as disclosed in U.S. Pat. No. 3,039,869, issued June 19, 1962. As examples of suitable combinations of auxiliary developing agents, mention may be made of 1-phenyl-3-pyrazolidone in combination with p-benzylaminophenol and 1-phenyl-3-pyrazolidone in combination with 2,5-bis-ethylenimino-hydroquinone. Such auxiliary developing agents may be employed in the liquid processing composition or they may be initially incorporated, at least in part, in any one or more of the silver halide emulsion strata, the strata containing the dye developers, the interlayers, the overcoat layer, the image-receiving layer, or in any other auxiliary layer, or layers, of the film unit. It may be noted that at least a portion of the dye developer oxidized during development may be oxidized and immobilized as a result of a reaction, e.g., an energy-transfer reaction, with the oxidation product of an oxidized auxiliary developing agent, the latter developing agent being oxidized by the development of exposed silver halide. Such a reaction of oxidized developing agent with unoxidized dye developer would regenerate the auxiliary developing agent for further reaction with the exposed silver halide.

In addition, development may be effected in the presence of an onium compound, particularly a quaternary ammonium compound, in accordance with the processes disclosed in U.S. Pat. No. 3,173,786, issued Mar. 16, 1965.

It will be apparent that the relative proportions of the agents of the diffusion transfer processing composition may be altered to suit the requirements of the operator. Thus, it is within the scope of this invention to modify the herein described developing compositions by the substitution of preservatives, alkalies, etc., other than those specifically mentioned, provided that the pH of the composition is initially at the first pH and solvent concentration required. When desirable, it is also contemplated to include, in the developing composition, components such as restrainers, accelerators, etc. Similarly, the concentration of various components may be varied over a wide range and when desirable adaptable components may be disposed in the photosensitive element, prior to exposure, in a separate permeable layer of the photosensitive element and/or in the photosensitive emulsion.

In all examples of this specification, percentages of components are given by weight unless otherwise indicated.

An extensive compilation of specific dye developers particularly adapted for employment in photographic diffusion transfer processes is set forth in aforementioned U.S. Pat. No. 2,983,606 and in the various copending U.S. applications referred to in that patent, especially in the table of U.S. applications incorporated by reference into the patent as detailed in column 27. As examples of additional U.S. patents detailing specific dye developers for photographic transfer process use, mention may also be made of U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,135,605; 3,135,606; 3,135,734; 3,141,772; 3,142,565; and the like.

In addition to conventional techniques for the direct dispersion of a particulate solid material in a polymeric, or colloidal, matrix such as ball-milling and the like techniques, the preparation of the dye developer dispersion may also be obtained by dissolving the dye in an appropriate solvent, or mixture of solvents, and the resultant solution distributed in the polymeric binder, with optional subsequent removal of the solvent, or solvents, employed as, for example, by vaporization where the selected solvent, or solvents, possesses a sufficiently low boiling point or washing where the selected solvent, or solvents, possesses a sufficiently high differential solubility in the wash medium, for example, water, when measured against the solubility of the remaining composition components, and/or obtained by dissolving both the polymeric binder and dye in a common solvent.

For further detailed treatment of solvent distribution systems of the types referred to above, and for an extensive compilation of the conventional solvents traditionally employed in the art to effect distribution of photographic color-providing materials in polymeric binders, specifically for the formation component layers of photographic film units, reference may be made to U.S. Pat. Nos. 2,269,158; 2,322,027; 2,304,939; 2,304,940; 2,801,171; and the like.

Although the invention has been discussed in detail throughout employing dye developers, the preferred image-providing materials, it will be readily recognized that other, less preferred, diffusion transfer process dye image-providing materials may be substituted in replacement of the preferred dye developers in the practice of the invention. For example, there may be employed dye image-forming materials which employ colored color coupling techniques comprising, at least in part, reacting one or more color developing agents and one or more colored color formers or couplers to provide a dye transfer image to a superposed image-receiving layer and those disclosed in U.S. Pat. Nos. 2,774,668 and 3,087,817, wherein color diffusion transfer processes are described which employ the imagewise differential transfer of complete dyes by the mechanisms therein described to provide a transfer dye image to a contiguous image-receiving layer, and thus including the employment of image-providing materials in whole or in part initially insoluble or nondiffusible as disposed in the film unit which diffuse during processing as a direct or indirect function of exposure.

The present invention also includes the employment of a black dye developer and the use of a mixture of dye developers adapted to provide a black-and-white transfer image, for example, the employment of dye developers of the three subtractive colors in an appropriate mixture in which the quantities of the dye developers are proportioned such that the colors combine to provide black.

Where in the specification, the expression "positive image" has been used, this expression should not be interpreted in a restrictive sense since it is used primarily for purposes of illustration, in that it defines the image produced on the image-carrying layer as being reversed, in the positive-negative sense, with respect to the image in the photosensitive emulsion layers. As an example of an alternative meaning for "positive image", assume that the photosensitive element is exposed to actinic light through a negative transparency. In this case, the latent image in the photosensitive emulsion layers will be a positive and the dye image produced on the image-carrying layer will be a negative. The expression "positive image" is intended to cover such an image produced on the image-carrying layer.

Where separation of the image receptor from the remainder of the film unit, subsequent to dye transfer image formation, is contemplated, it will be understood and appreciated that the support for and/or the receptor layer retaining the transfer image, especially when self-sustaining, may be constituted as a projection or transparency image or print or, at the election of the operator, a reflection print, the latter readily accomplished by appropriate selection of an opaque, preferably reflecting, support member and/or the addition or distribution of reflecting adjuvant associated with the dye image carried by the receptor layer.

It will be recognized that, by reason of the preferred film units' structural parameters, the transfer image formed upon directed exposure of the film unit to a selected subject and processing, will be a geometrically reversed image of the subject. Accordingly, to provide transfer image formation geometrically nonreversed, exposure of such film unit should be accomplished through an image-reversing optical system such a camera possessing an image-reversing optical system.

In addition to the described layers it will be recognized that the film unit may also contain one or more subcoats or layers, which, in turn, may contain one or more additives such as plasticizers, intermediate layers for the purpose, for example, of improving adhesion, and that any one or more of the described layers may comprise a composite of two or more strata of the same, or different, components and which may be contiguous, or separated from, each other, for example, two or more neutralizing layers or the like, one of which may be disposed intermediate the cyan dye image-forming component retaining layer and the dimensionally stable opaque layer.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. A composite photographic diffusion transfer process film unit which comprises a plurality of sequential layers arranged in substantially parallel planar relationship including, in combination:

a dimensionally stable layer having one side serving as an external surface of said film unit, a composite photosensitive unit comprising:

a first layer comprising a particulate dispersion of photosensitive silver halide grains possessing first means particle size and exhibiting gamma value within the range of about 1.7 to 3.0; and a second layer comprising a particulate dispersion of photosensitive silver halide grains possessing a second mean particle size less than said first mean particle size, being spectrally sensitive within the sensitivity range of said first layer silver halide grains and combined with a diffusion transfer process dye image-forming material having a spectral absorption characteristic within the spectral sensitivity range of the said silver halide grains of said first and second layers, said second layer exhibiting a gamma value within the range of about 1.7 to 3.0;

said gamma values of said first and second layers differing from each other by at least 0.25;

the diffusion transfer speed of said first layer being greater than that of said second layer by an amount equivalent to about four to seven stops;

said first layer being contiguous with said second layer and being positioned intermediate said second layer and the exposure surface of said film unit;

said first layer being substantially free of diffusion transfer process dye image-forming material;

said composite photosensitive unit exhibiting a predetermined gamma within a range of 1.1 to 1.7;

receptor means including a layer adapted to receive diffusion transfer process dye image-forming material diffusing thereto as a function of the point-to point degree of said photosensitive unit's exposure to incident actinic radiation; and means for providing a processing composition intermediate said photosensitive unit and said receptor means.

2. The photographic diffusion transfer process film unit as defined in claim 1 said processing composition including opacifying agent, in a quantity sufficient to mask dye image-forming material associated with said second layer, adapted to be disposed intermediate said composite photosensitive unit and said layer adapted to receive diffusion transfer process dye image-forming material diffusing thereto.

3. The photographic diffusion transfer process film unit of claim 1 in which said receptor means comprises a dimensionally stable support layer carrying said image-receiving layer.

4. The photographic diffusion transfer color process film unit of claim 1 wherein said first layer is substantially dye free and comprises a particulate dispersion of photosensitive silver iodochlorobromide, silver iodochloride or silver iodobromide grains.

5. The photographic diffusion transfer color process film unit of claim 1 wherein said first and second particulate dispersions of photosensitive silver halide grains comprise particulate dispersions of photosensitive silver iodochlorobromide, silver iodochloride, or silver iodobromide grains possessing a mean grain size within the range of about 0.2 to 3.0 microns.

6. The photographic diffusion transfer color process film unit as defined in claim 5 wherein diffusion transfer process dye image-forming material is present in said second layer at a coverage of 20 to 100 mgs./ft.$^2$ and said photosensitive silver halide is present in said composite unit at a coverage of 40 to 200 mgs./ft.$^2$.

7. The photographic diffusion transfer color process film unit as defined in claim 1 wherein said processing composition possesses a pH at which dye image-forming material is soluble and diffusible as a function of the point-to point degree of said first and second layers' exposure to incident actinic radiation.

8. The photographic diffusion transfer color process film unit as defined in claim 7 including means for converting the pH of the film unit from said pH at which said dye image-forming material is soluble and diffusible as a function of said first and second layers' exposure to incident actinic radiation to a second pH at which said dye image-forming material is substantially nondiffusible, subsequent to substantial diffusion of solubilized dye image-forming material to said receptor means layer.

9. The photographic diffusion transfer color process film unit as defined in claim 7 wherein said means for providing a processing composition comprises a rupturable container retaining said processing composition positioned extending transverse an edge of the film unit to effect, upon application of compressive pressure to said container, discharge of said container's processing composition contents into contact with said photosensitive units' first and second layers.

10. The photographic diffusion transfer color process film unit as defined in claim 9 wherein said rupturable container retaining said processing composition is adapted, upon application of compressive pressure to the container, to discharge the container's processing composition contents intermediate said photosensitive unit and said receptor means.

11. The photographic diffusion transfer color process film unit as defined in claim 10 in which said processing composition includes opacifying agent in a quantity sufficient to mask dye image-forming material associated with said photosensitive unit.

12. The photographic diffusion transfer color process film unit as defined in claim 11 wherein said receptor means includes a dimensionally stable transparent layer positioned contiguous the surface of said layer adapted to receive dye image-forming material diffusing thereto and opposite said photosensitive unit.

13. The photographic diffusion transfer color process film unit as defined in claim 1 wherein said dye image-forming material is a dye which is a silver halide developing agent.

14. A photographic diffusion transfer color process film unit which comprises, in combination:

a photosensitive element including a plurality of sequential layers arranged in parallel planar relationship comprising a dimensionally stable layer having an externally disposed surface; at least two selectively sensitized photosensitive silver halide containing units possessing predominant spectral sensitivity to separate regions of the visible electromagnetic spectrum, said photosensitive units each exhibiting a predetermined gamma of substantially the same value and within a range of 1.1 to 1.7, at least one of said photosensitive units being a composite unit including a first layer comprising a particulate dispersion of photosensitive silver iodochlorobromide, iodochloride or iodobromide grains which possess a first mean particle size and exhibits a first gamma value within a range of about 1.7 to 3.0, and in a contiguous parallel planar relationship, a second layer comprising a particulate dispersion of photosensitive silver iodochloride, iodobromide or iodochlorobromide grains spectrally sensitive within the sensitivity range of said first layer grains, which possess a second means particle size less than said first means particle size, and a diffusion transfer process dye image-forming material possessing spectral absorption within the spectral range to which said second layer silver halide is sensitive, said second layer exhibiting a second gamma value within the range, of about 1.7 to 3.0, the diffusion transfer speed separation between said first and second layers having the equivalence of greater than or equal to 1 and less than or equal to 7 stops, said first gamma value differing from said second gamma by at least 0.25, said first layer being positioned intermediate said second layer and the exposure surface of the film unit, and said first layer being substantially free of dye image-forming material;

a polymeric layer dyeable by diffusion transfer process dye image-forming material;

a dimensionally stable transparent layer;

means securing the layers in substantially fixed relationship; and a rupturable container retaining a processing composition positioned and extending transverse an edge of the photosensitive element to effect unidirectional discharge of the container's processing composition into contact with the photosensitive units.

15. The photographic diffusion transfer color process film unit as defined in claim 14 in which said first and second layer gamma values are greater than the said predetermined value of gamma exhibited by said photosensitive units.

16. The photographic diffusion transfer color process film unit as defined in claim 14 in which said first and second means particle sizes of the respective said first and second layers are within the range of about 0.2 to 3.0 microns.

17. The photographic diffusion transfer color process film unit of claim 14 in which said photosensitive element is structured to include a composite structure containing, as essential layers, in sequence, a dimensionally stable opaque layer which is alkaline solution impermeable; a said composite photosentive unit including a red-sensitive silver halide emulsion having associated therewith a cyan dye; a said composite photosensitive unit having a green-sensitive silver halide emulsion having associated therewith a magenta dye; a photosensitive unit including a blue-sensitive silver halide emulsion with an associated yellow dye;

each said cyan, magenta and yellow dyes being silver halide developing agents soluble and diffusible, in alkaline processing composition, at a first pH;

a polymeric layer contains sufficient acidifying capacity to effect reduction of a processing composition having said first pH at which said cyan, magenta and yellow dyes are soluble and diffusible to a second pH at which cyan, magenta and yellow dyes are substantially nondiffusible; and said rupturable container retains an aqueous alkaline processing composition having said first pH at which said cyan, magenta and yellow dyes ar soluble and diffusible and opacifying agent in a quantity sufficient to mask, upon distribution of the aqueous alkaline processing composition as a layer, intermediate said dyeable polymeric layer and said blue-sensitive silver halide emulsion containing photosensitive unit, cyan, magenta and yellow dye associated with said red-, green-, and blue-sensitive emulsion layers, and container fixedly positioned and extending transverse an edge of the photosensitive element to effect, upon application of compressive force to said container, unidirectional discharge of the container's aqueous alkaline processing composition contents intermediate said dyeable polymeric layer and said photosensitive unit incorporating said blue-sensitive silver halide emulsion.

18. A process of forming transfer images in color which comprises the steps of:

a. exposing a photographic film unit which comprises:

a plurality of sequential layers arranged in substantially parallel planar relationship including, in combination: a dimensionally stable layer having one side serving as an external surface of said film unit; a composite photosensitive unit comprising: a first layer comprising a particulate dispersion of photosensitive silver halide grains possessing a first mean particle size and exhibiting gamma value within the range of about 1.7 to 3.0; and a second layer comprising a particulate dispersion of photosensitive silver halide grains possessing a second means particle size, less than said first means particle size, being spectrally sensitive within the sensitivity range of said first layer silver halide grains and combined with a diffusion transfer process dye image-forming material having a spectral absorption characteristic within the spectral sensitivity range of the said silver halide grains of said first and second layers, said second layer exhibiting a gamma value within the range of about 1.7 to 3.0; said gamma values of said first and second layers differing from each other by at least 0.25; the diffusion transfer speed of said first layer being greater than that of said second layer by an amount equivalent to about four to seven stops; said second layer being contiguous with said first layer and intermediate said first layer with said dimensionally stable opaque layer;

said first layer being substantially free of diffusion transfer process dye image-forming material;

said composite photosensitive unit exhibiting a predetermined gamma within a range of 1.1 to 1.7;

b. contacting said photosensitive silver halide containing photosensitive unit with a processing composition;

c. effecting thereby development of said photoexposed silver halide containing layer;

d. forming thereby an imagewise distribution of diffusible dye image-providing material, as a function of the point-to-point degree of said silver halide containing layer's exposure incident actinic radiation; and e. transferring by diffusion at least a portion of said imagewise distribution of said diffusible dye image-providing material to an image-receiving element dyeable by said dye image-providing material to provide thereto a dye image in terms of said imagewise distribution, said processing composition being provided intermediate said photosensitive unit and said image-receiving element.

19. A process of forming transfer images in color as defined in claim 18 wherein said first layer comprises a particulate dispersion of photosensitive silver iodochlorobromide, silver iodochloride, or silver iodobromide grains.

20. A process of forming transfer images in color as defined in claim 19 wherein said dispersion comprising said photosensitive silver halide iodochlorobromide, silver iodochloride or silver iodobromide dispersion possesses a means grain size with the range of about 0.2 to 3.0

21. A process of forming transfer images in color as defined in claim 18 wherein each of said first and second layer comprises photosensitive silver iodochlorobromide, silver iodochloride or silver iodobromide grains.

22. A process of forming transfer images in color as defined in claim 21 wherein diffusion transfer process dye image-forming material is present in said second photosensitive layer at a coverage of 30 to 150 mgs./ft.$^2$ and said photosensitive silver halide is present in said composite unit at a coverage of 40 to 150 mgs./ft.$^2$.

23. A process of forming transfer images in color as defined in claim 22 wherein said dye image-providing material is a dye which is a silver halide developing agent.

* * * * *

UNITED STATES PATENT AND TRADEMARK OFFICE

CERTIFICATE OF CORRECTION

PATENT NO. : 4,003,744

DATED : January 18, 1977

INVENTOR(S) : Peter O. Kliem

It is certified that error appears in the above-identified patent and that said Letters Patent are hereby corrected as shown below:

Column 2, line 36, "the" should be --be--.

Column 3, line 20, after "opaque" insert --layer--.

Column 3, line 43, "processes" should be --possesses--.

Column 4, line 5, after "film" insert --unit--.

Column 4, line 42, after "less" insert --than--.

Column 6, line 18, "protective" should be --protection--.

Column 6, line 63, after "representing" insert --the--.

Column 11, line 31, after "therewith" delete "with".

Column 12, line 55, after "24 hrs." insert --/--.

Column 13, line 42, "obaque" should be --opaque--.

Column 16, line 20, "Im" should be --In--.

Column 17, line 3, "strate" should be --strata--.

Column 17, line 42, "iodochloro-bromide" should be --iodochlorobromide--.

Column 35, line 57, after "processing" insert --a--.

Column 35, line 58, "means" should be --mean--.

UNITED STATES PATENT AND TRADEMARK OFFICE

CERTIFICATE OF CORRECTION

PATENT NO. : 4,003,744

DATED : January 18, 1977

INVENTOR(S) : Peter O. Kliem

It is certified that error appears in the above-identified patent and that said Letters Patent are hereby corrected as shown below:

Column 38, line 23, "means" should be --mean--.

Column 38, line 42, "contains" should be --containing--.

Column 38, line 50, "ar" should be --are--.

Column 38, line 58, "and" should be --said--.

Column 39, line 13, "means" should be --mean--.

Column 39, line 14, "means" should be --mean--.

Column 39, line 29, "with" should be --and--.

Column 40, line 23, "means" should be --mean--.

Column 40, line 24, after "3.0" insert --μ--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*